US009763021B1

(12) United States Patent
Peeler et al.

(10) Patent No.: US 9,763,021 B1
(45) Date of Patent: Sep. 12, 2017

(54) SYSTEMS AND METHODS FOR DISPLAY OF NON-GRAPHICS POSITIONAL AUDIO INFORMATION

(71) Applicants: Doug J. Peeler, Austin, TX (US); Mark A. Casparian, Miami, FL (US); Joe A. Olmsted, Cedar Park, TX (US)

(72) Inventors: Doug J. Peeler, Austin, TX (US); Mark A. Casparian, Miami, FL (US); Joe A. Olmsted, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 15/223,613

(22) Filed: Jul. 29, 2016

(51) Int. Cl.
*H04R 5/00* (2006.01)
*H04S 7/00* (2006.01)

(52) U.S. Cl.
CPC ..... *H04S 7/40* (2013.01); *H04S 2400/01* (2013.01)

(58) Field of Classification Search
CPC . H04S 7/40; H04S 7/303; H04S 7/302; H04S 2400/001; H04S 2400/11; H04S 2400/15; H04S 2420/01; H04R 5/00; H04R 29/008; H04R 2499/15; H04R 2499/11
USPC ..... 381/1, 2, 12
See application file for complete search history.

(56) References Cited

U.S. PATENT DOCUMENTS 7,772,987 B2 8/2010 Shows
7,850,525 B2 12/2010 Shimizu et al.
8,411,029 B2 4/2013 Casparian et al.
8,700,829 B2 4/2014 Casparian et al.
8,841,535 B2 9/2014 Collins
9,111,005 B1 8/2015 Ross et al.
9,272,215 B2 3/2016 Casparian et al.
9,368,300 B2 6/2016 Casparian et al.
2013/0294637 A1* 11/2013 Kitatani ..... H04S 7/30 381/387
2014/0281618 A1 9/2014 Sultenfuss et al.
2015/0098603 A1 4/2015 Kulavik et al.
2015/0196844 A1 7/2015 Liendo et al.
2016/0117793 A1 4/2016 Sierra et al.
2017/0105081 A1* 4/2017 Jin ..... H04R 29/008

OTHER PUBLICATIONS

Asus, Motherboard, Maximus VI, Formula, Jun. 2013, 212 pgs.
Holloway et al., "Visualizing Audio in a First Person Shooter With Directional Sound Display",Gaxid, Jun. 2011, 4 pgs.
(Continued)

*Primary Examiner* — Paul S Kim
*Assistant Examiner* — Sabrina Diaz
(74) *Attorney, Agent, or Firm* — Egan Peterman Enders Huston

(57) ABSTRACT

Systems and methods are disclosed herein that may be implemented to use multiple light sources to visually display non-graphics positional audio information based on multi-channel audio information produced by a computer application executing on a processor of an information handling system. The multiple light sources may be operated separately and independently from a user's computer display device, and the non-graphics positional audio information may be separate and different from any visual graphics data that is generated by the computer application or information handling system.

20 Claims, 13 Drawing Sheets

(56) References Cited

OTHER PUBLICATIONS

Ernawan et al., "Spectrum Analysis of Speech Recognition Via Discrete Tchebichef Transform", Proceedings of SPIE, Oct. 2011, 9 pgs.
Microsoft, "Introduction to Port Class" Printed from Internet Jul. 19, 2016, 3 pgs.
Microsoft, "Implementing Hardware Offloaded APO Effects" Printed from Internet Jul. 18, 2016, 4 pgs.
Microsoft, "Audio Processing Object Architecture", Printed from Internet Jul. 15, 2016, 9 pgs.
Microsoft, "What's New in Audio for Windows 10", Printed from Internet Jun. 23, 2016, 9 pgs.
Microsoft, "What's New in Audio for Windows 10", Printed from Internet Mar. 1, 2016, 7 pgs.
Hindes, "Is the ASUS ROG Sonic Radar a Cheat?", Printed from Internet Jun. 29, 2015, 8 pgs.
Microsoft, "Installing Custom sAPOs", Printed from Internet Jul. 28, 2016, 3 pgs.
Microsoft, "sAPOs and the Windows Vista Audio Architecture", Printed from Internet Jul. 28, 2016, 2 pgs.
Microsoft, "Exploring the Windows Vista Audio Engine", Printed From Internet Jul. 28, 2016, 3 pgs.

* cited by examiner

SYSTEMS AND METHODS FOR DISPLAY OF NON-GRAPHICS POSITIONAL AUDIO INFORMATION

FIELD

This application relates to lighting, and more particularly to lighting for information handling systems.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

When users play Microsoft Windows-based first person shooter PC games, the user's attention is typically drawn to two things displayed on a computer display device: a mini-map that shows where opponents are positioned relative to the user, and the gun sight on the user's gun barrel for aiming. The game content may support multi-channel audio, such as 5.1 and 7.1 surround sound, for output as sound from speakers or headphones. However, in some cases the user's PC system may only have a stereo audio codec, in which case multi-channel positional sound is not available to the user.

SUMMARY

Systems and methods are disclosed herein that may be implemented to use multiple light sources to visually display non-graphics positional audio information based on multi-channel audio information produced by a computer application running on an information handling system. The multiple light sources may be, for example, individual light-emitting diodes (LEDs), organic light-emitting diodes (OLEDs), etc. The multiple light sources may be non-graphics light sources that are separate and different from (and that are operated separately and independently from) the backlighting for a user's integrated or external computer display device (e.g., such as LED or LCD display device that displays graphics produced by the computer application), and the non-graphics positional audio information may be separate and different from any visual graphics data that is generated by the computer application or information handling system. In such an embodiment, the disclosed systems and methods may be advantageously implemented in a manner that does not display the positional audio information on the active display area of the computer display device itself, i.e., the positional audio information is therefore not overlaid on top of or otherwise displayed with the displayed game graphics information (or graphics information of other type of audio-generating user application) on the user's computer display device.

In one embodiment, positional audio information produced by an application such as an online computer gaming application (e.g., filtered sounds such as gun fire, footsteps, explosions, etc.) may be visually displayed to a user in a manner that allows the user to see an indication of direction, distance and/or type of a sound source within the game, without displaying this information on top of the game graphics on the user's display device and thus without risk that the Game Publisher or League may incorrectly perceive that the user is cheating, which could result in the Game Publisher or League banning or temporarily suspending the user from playing the game online, or simply demoting the user (player) to a lower rank. This capability may be used to provide the user with an edge or advantage during game play.

In one embodiment, multiple individual light sources may be provided around the periphery (e.g., on a bezel) of a notebook computer display device, stand-alone computer display device, or All In One Desktop computer display device to allow a user to visually see (e.g., using peripheral vision) positional audio information displayed by the light sources without requiring the user to take their eyes off of the graphics (e.g., gun sight or mini-map produced by a computer game) that are displayed by an application on the user's computer display device. In another embodiment, multiple individual light sources that are used to display positional audio information may be additionally or alternatively provided around the periphery of a notebook or stand-alone keyboard, and/or may be provided within or beneath individual keys of a notebook or stand-alone keyboard. Other embodiments are possible, and the disclosed systems and methods may be implemented using light sources that are provided on or within integrated or external (i.e., computer peripheral) information handling system hardware components other than keyboards and display devices, such as mouse, notebook computer chassis, tablet computer chassis, desktop computer chassis, docking station, virtual reality glove or goggles, etc. It is also possible that the individual light sources and their associated control circuitry may be configured to be temporarily clamped onto the outer surface of an information handling system component such as keyboard or display device, e.g., to allow a conventional information handling system to be retrofit to visually display non-graphics positional audio information based on multi-channel audio information.

In one embodiment, the disclosed systems and methods may be implemented using a Communication Application Programming Interface (API) that is configured to receive an input that includes multi-channel audio information produced by a computer game (or any other type of sound-generating computer application) and to map each discrete channel of the audio information for lighting one or more defined lighting zones that each include one or more light sources, such as LEDs. The multi-channel audio information may be extracted in any suitable manner, e.g., such as using a custom Audio Processing Object (APO) or a Virtual Audio driver. In any case, the multi-channel audio information may be copied and sent to the Communication API. At the same time, the multi-channel audio information may be optionally passed through to an Audio Driver, e.g., for rendering on a device hardware audio endpoint, such as speakers, headphone, etc. In another embodiment, multiple zones of positional audio lighting hardware may be integrated into a computer peripheral (e.g., such as aftermarket or stand-alone display device or computer keyboard), and positional audio information software (e.g., such as the aforesaid API together with APO or virtual audio driver) may be provided on computer disk, flash drive, or a link for download from the Internet.

In one exemplary embodiment, the lighting zones may be defined on (and optionally around) the perimeter of the bezel of a user graphics display or keyboard so that the multi-channel audio information may be mapped by the API to the respective lighting zones in order to provide a visual cue of a given application-generated sound event to a user. For example, 5.1 multi-channel audio content includes center, front left, front right, surround left, surround right, and Low Frequency Effects (LFE) channels. In one such exemplary embodiment, an audio signal present in the center channel may cause a lighting element located at the top center of the display or keyboard to be illuminated, an audio signal present in the front left channel may cause a lighting element located at the top left of the display or keyboard to be illuminated, an audio signal present in the front right channel may cause a lighting element located at the top right of the display or keyboard to be illuminated, etc. In a further embodiment, illumination intensity of each given lighting element may be based on one or more aspects or characteristics (e.g., such as sound volume level, sound frequency, etc.) of the audio stream event in the corresponding respective channel that is mapped to the given lighting element.

In one respect, disclosed herein is a method of displaying display non-graphics positional audio information using an information handling system, including: producing multi-channel audio information from at least one application program executing on at least one processing device of the information handling system, each of the multiple audio channels of the multi-channel audio information representing a different direction of sound origin relative to a virtual point of reference within a graphics scene generated by the application program; and illuminating at least one different non-graphics light source of a group of multiple non-graphics light sources in response to the audio information contained in each of the multiple different audio channels of the multi-channel audio information, each of the multiple non-graphics light sources being positioned on or within an integrated or external computer hardware component in a different direction from a selected point of reference on the integrated or external computer hardware component that is selected to correspond to the virtual point of reference within the graphics scene generated by the application program.

In another respect, disclosed herein is an information handling system, including: at least one integrated or external computer hardware component; multiple non-graphics light sources being positioned on or within the integrated or external computer hardware component; at least one processing device coupled to control illumination of the multiple light sources, the at least one processing device being programmed to: execute at least one application program to simultaneously generate a graphics scene and multi-channel audio information associated with the graphics scene, each of the multiple audio channels of the multi-channel audio information representing a different direction of sound origin relative to a virtual point of reference within the graphics scene generated by the application program; and control illumination of at least one different non-graphics light source of a group of multiple non-graphics light sources in response to the audio information contained in each of the multiple different audio channels of the multi-channel audio information, each of the multiple non-graphics light sources being positioned on or within an integrated or external computer hardware component in a different direction from a selected point of reference on the integrated or external computer hardware component that is selected to correspond to the virtual point of reference within the graphics scene generated by the application program.

In another respect, disclosed herein is an information handling system, including: at least one processing device configured to be coupled to at least one integrated or external computer hardware component, the at least one integrated or external hardware component having multiple non-graphics light sources being positioned on or within the integrated or external computer hardware component. The at least one processing device may be programmed to control illumination of the multiple light sources when the processing device is coupled to the integrated or external computer hardware component, the at least one processing device being programmed to: execute at least one application program to simultaneously generate a graphics scene and multi-channel audio information associated with the graphics scene, each of the multiple audio channels of the multi-channel audio information representing a different direction of sound origin relative to a virtual point of reference within the graphics scene generated by the application program; and generate lighting event commands to cause illumination of at least one different non-graphics light source of a group of multiple non-graphics light sources in response to the audio information contained in each of the multiple different audio channels of the multi-channel audio information, each of the multiple non-graphics light sources being positioned on or within an integrated or external computer hardware component in a different direction from a selected point of reference on the integrated or external computer hardware component that is selected to correspond to the virtual point of reference within the graphics scene generated by the application program.

DESCRIPTION OF ILLUSTRATIVE EMBODIMENTS

Figure 1A:
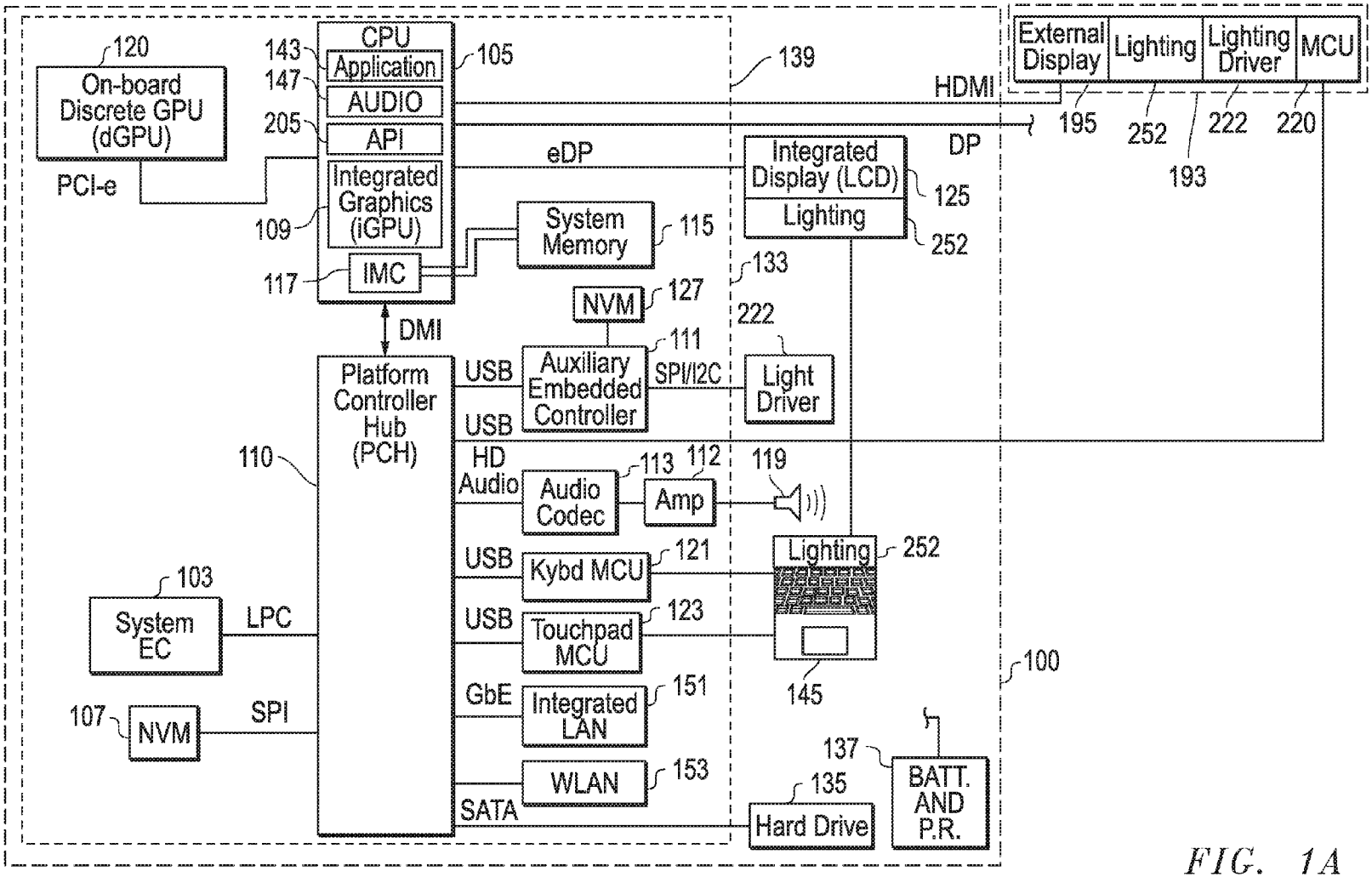
FIG. 1A illustrates a block diagram of portable information handling system according to one exemplary embodiment of the disclosed systems and methods.

FIG. 1A is a block diagram illustrating a portable information handling system chassis 100 coupled to an optional external display device 193 as it may be configured to according to one exemplary embodiment of the disclosed systems and methods. In one embodiment, portable information handling system chassis 100 may be a battery-powered portable information handling system that is configured to be optionally coupled to an external source of system (DC) power, for example AC mains and an AC adapter. Information handling system may also include an internal DC power source 137 (e.g., smart battery pack and power regulation circuitry) that is configured to provide system power source for the system load of information handling system, e.g., when an external source of system power is not available or not desirable. Portable information handling system chassis 100 may be, for example, a notebook or laptop computer, and may be configured with a chassis enclosure delineated as shown by the outer dashed outline. However, it will be understood that the disclosed systems and methods may be implemented in other embodiments for other types of portable information handling systems. Further information on powered information handling system architecture and components may be found in United States Patent Application Publication Number 20140281618A1, which is incorporated herein by reference in its entirety. It will also be understood that the particular configuration of FIG. 1A is exemplary only, and that an information handling system may be configured with fewer, additional or alternative components than those illustrated and described herein.

As shown in FIG. 1A, information handling system chassis 100 of this exemplary embodiment includes various integrated components that are embedded on a system motherboard 139, it being understood that any one or more of such embedded components may be alternatively provided separate from motherboard 139 within a chassis case 100 of a portable information handling system, e.g., such as provided on a daughter card or other separate mounting configuration. As further shown, a host processing device 105 which may be provided that is a central processing unit CPU such as an Intel Haswell processor, an Advanced Micro Devices (AMD) Kaveri processor, or one of many other suitable processing devices currently available. In this embodiment, a host processing device in the form of CPU 105 may execute a host operating system (OS) for the portable information handling system. System memory may include main system memory 115 (e.g., volatile random access memory such as DRAM or other suitable form of random access memory) coupled (e.g., via DDR channel) to an integrated memory controller (iMC) 117 of CPU 105 to facilitate memory functions, although it will be understood that a memory controller may be alternatively provided as a separate chip or other circuit in other embodiments. Not shown is optional nonvolatile memory (NVM) such as Flash, EEPROM or other suitable non-volatile memory that may also be coupled to CPU 105.

As shown in FIG. 1A, CPU 105 itself includes an integrated GPU (iGPU) 109 and portable information handling system chassis 100 may also include an optional separate internal discrete GPU (I-dGPU) 120. In one mode of operation, video content from CPU 105 may be sourced at any given time either by iGPU 109 or I-dGPU 120. Further information on integrated and discrete graphics maybe found, for example, in United States Patent Application Publication Number 20160117793A1, which is incorporated herein in its entirety for all purposes. As shown in FIG. 1A, a display component 195 (e.g., LCD or LED flat panel display) of external display device 193 may be optionally coupled by suitable connector and external video cabling (e.g., via digital HDMI or DVI, analog D-Sub/S VGA, etc.) to receive and display visual images received from iGPU 109 or I-dGPU 120 of information handling system 100. I-dGPU 120 may be, for example, a PCI-Express (PCI-e) graphics card that is coupled to an internal PCI-e bus of portable information handling system chassis 100 by multi-lane PCI-e slot and mating connector. It will be understood that PCI-e is just one example of a suitable type of data bus interface that may be employed to route graphics data between internal components within portable information handling system chassis 100.

As further illustrated in FIG. 1A, CPU 105 may be coupled to embedded platform controller hub (PCH) 110 which may be present to facilitate input/output functions for the CPU 105 with various internal components of information handling system 100. In this exemplary embodiment, PCH 110 is shown coupled to other embedded components on a motherboard 133 (remove 139) that include system embedded controller 103 (e.g., used for real time detection of events, etc.), non-volatile memory 107 (e.g., storing BIOS, etc.), wireless network card (WLAN) 153 for Wi-Fi or other wireless network communication, integrated network interface card (LAN) 151 for Ethernet or other wired network connection, touchpad microcontroller (MCU) 123, keyboard microcontroller (MCU) 121, audio codec 113, audio amplifier 112, and auxiliary embedded controller 111 which may be implemented by a microcontroller. Also shown coupled to PCH 110 are other non-embedded internal components of information handling system 100 which include integrated display 125 (e.g., LCD or LED flat panel display integrated into notebook computer lid or tablet, or other suitable integrated portable information handling system display device), audio endpoint in the form of internal speaker 119, integrated keyboard and touchpad 145, and local hard drive storage 135 or other suitable type of system storage including permanent storage media such as solid state drive (SSD), optical drives, NVRAM, Flash or any other suitable form of internal storage.

The tasks and features of auxiliary embedded controller 111 may include, but are not limited to, controlling various possible types of non-graphics light sources 252 based on multi-channel audio information produced by a computer game (or any other type of sound-generating computer application of application layer 143) executing on CPU 105 in a manner as described elsewhere herein. As shown, light sources 252 may include light element/s (e.g., LED's, OLEDs, etc. integrated within keyboard 145 and/or integrated within bezel surrounding integrated display device 125) that may be controlled by auxiliary embedded controller 111 based on multi-channel audio information to achieve integrated lighting effects for the portable information handling system chassis 100. One example of auxiliary EC 111 is an electronic light control (ELC) controller such as described in U.S. Pat. No. 8,411,029 which is incorporated herein by reference in its entirety. In similar fashion, light sources 252 of external display device 193 may be controlled based on multi-channel audio information to achieve lighting effects by external microcontroller 220 that may be integrated into external display 193 as shown. In one exemplary embodiment, a lighting control MCU 220 may be implemented by a keyboard controller such as illustrated and described in U.S. Pat. No. 8,411,029; and U.S. Pat. No. 9,272,215, each of which is incorporated herein by reference in its entirety for all purposes.

As shown in the exemplary embodiment of FIG. 1A, a light driver chip 222 (e.g., red-green-blue "RGB" LED light driver chip such as Texas Instruments TLC59116F) or other suitable light driver circuitry may be integrated within the chassis of information handling system 100 (e.g., embedded on motherboard 133 of FIG. 1A) and may be coupled to auxiliary embedded controller 111, e.g., by serial peripheral interface "SPI", Inter-integrated Circuit "I2C" or any other suitable digital communication bus. Similarly, a light driver chip 222 or other suitable light driver circuitry may be integrated into external display device 193 and may be coupled to MCU 220 of external display device, e.g., by serial peripheral interface "SPI", Inter-integrated Circuit "I2C" or any other suitable digital communication bus.

In this embodiment, auxiliary embedded controller 111 and MCU 220 may each be configured to communicate lighting control signals to a corresponding light driver chip 222 to control lighting colors, luminance level and effects (e.g. pulsing, morphing). Each light driver chip 222 may be in turn coupled directly via wire conductor to drive light sources 252 (e.g., RGB LEDs such as Lite-On Technology Corp part number LTST-008BGEW-DF_B-G-R or other suitable lighting elements) based on the lighting control signals received from auxiliary EC 111 or MCU 220 as the case may be. Examples of lighting control technology and techniques that may be utilized with the features of the disclosed systems and methods may be found, for example, in U.S. Pat. No. 7,772,987; U.S. Pat. No. 8,411,029; U.S. Pat. No. 9,272,215; United States Patent Publication No. 2015/0196844A1 and U.S. Pat. No. 9,368,300, each of which is incorporated herein by reference in its entirety.

As further shown in FIG. 1A, persistent storage (e.g., non-volatile memory) may be additionally coupled to PCH 110, system EC 103 and/or auxiliary EC 111. Such persistent storage may store or contain firmware or other programming that may be used by EC 103 and/or EC 111 to implement one or more user-defined system configurations such as keyboard lighting options, display lighting options, audio output settings, power management settings, performance monitoring recording settings, designated keyboard macros and/or variable pressure key settings and/or macros, for example, in a manner such as described in U.S. Pat. No. 7,772,987; U.S. Pat. No. 8,700,829, U.S. Pat. No. 8,411,029; U.S. Pat. No. 9,272,215; United States Patent Publication No. 2015/0196844A1 and U.S. Pat. No. 9,368,300, each of which is incorporated herein by reference in its entirety. In one example illustrated in FIGS. 1A and 1B, dedicated non-volatile memory 127 may be directly coupled to auxiliary EC 111 for this purpose as shown.

As will be described further herein, CPU 105 is programmed in the embodiment of FIG. 1A to execute an audio engine 147 that is configured to perform signal processing (DSP) on multi-channel audio data stream received from one or more user applications of application layer 143 that in this embodiment are also executing on CPU 105. Example protocols for such multi-channel audio streams include, but are not limited to, Linear Pulse Code Modulation, DTS Digital Surround, Dolby Digital Plus, or Dolby Atmos surround sound protocols, stereo audio, or any other suitable surround sound or multi-channel audio protocol. Audio engine 147 may be implemented, for example, using Microsoft Windows Driver Model (WDM) audio architecture (e.g., available from Microsoft Corporation as part of Windows Vista, Windows 8, Windows 10) that produces a multi-channel audio signal output signal for audio amplifier 112 and audio endpoint in the form of speaker/headphones 119 based on the input multi-channel audio data stream from application layer 143. In this embodiment audio engine 147 also processes the multi-channel audio data stream from application layer 143 to produce multi-channel audio information that is further processed and provided as lighting event command signals from CPU 105 to auxiliary controller 111. Auxiliary controller 111 in turn produces lighting control signals for light driver chip 222 based on the lighting event command signals provided from CPU 105.

Figure 1B:
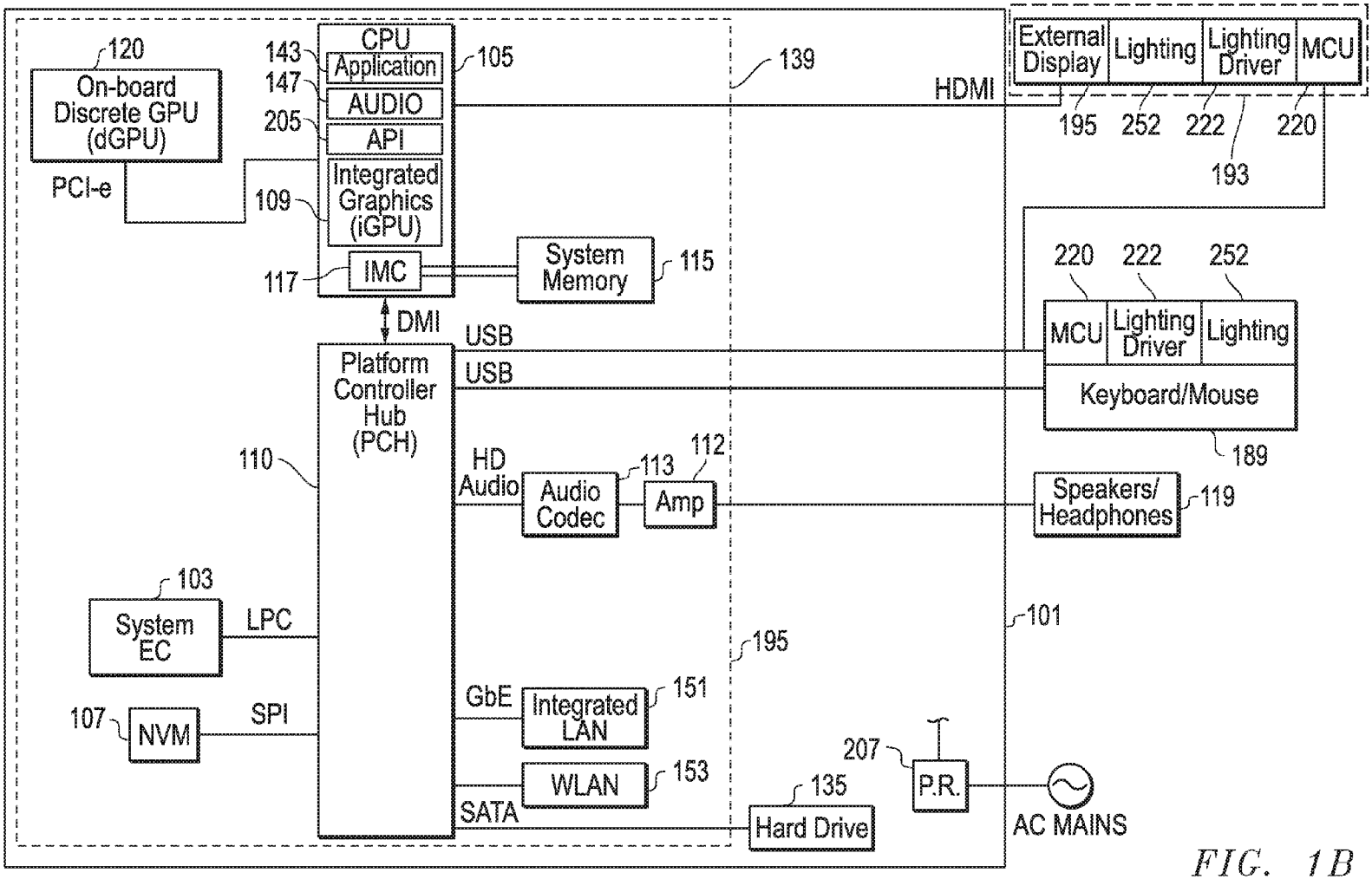
FIG. 1B illustrates a block diagram of a non-portable information handling system according to one exemplary embodiment of the disclosed systems and methods.

FIG. 1B is a block diagram illustrating a non-portable embodiment of an information handling system chassis 101 (e.g., such as desktop computer tower) that is coupled to external components that include keyboard and/or mouse 189, external display 193, and speakers and/or headphones 119. As shown, information handling system circuit components of this embodiment of chassis 101 are powered by AC Mains via AC/DC power regulation circuitry 207. In FIG. 1B, light sources 252 may be integrated (together with external microcontrollers 220 and external light drivers 222) into keyboard/mouse 189 and/or external display 193. Otherwise, this embodiment employs similar information handling system components as the portable information handling system of FIG. 1A, except that external microcontrollers (MCUs) 220 and external light drivers 222 control light sources 252 based on lighting event command signals that are based on multi-channel audio information provided by audio engine 147 executing on CPU 105 in a manner as described elsewhere herein. In this embodiment, lighting event command signals may be provided to external MCUs 220 via any suitable communication medium, e.g., such as USB or other suitable communication bus. As previously described, a lighting control MCU 220 may be implemented in one exemplary embodiment by a keyboard controller such as illustrated and described in U.S. Pat. No. 8,411,029; and U.S. Pat. No. 9,272,215, each of which is incorporated herein by reference in its entirety for all purposes.

Figure 2A:
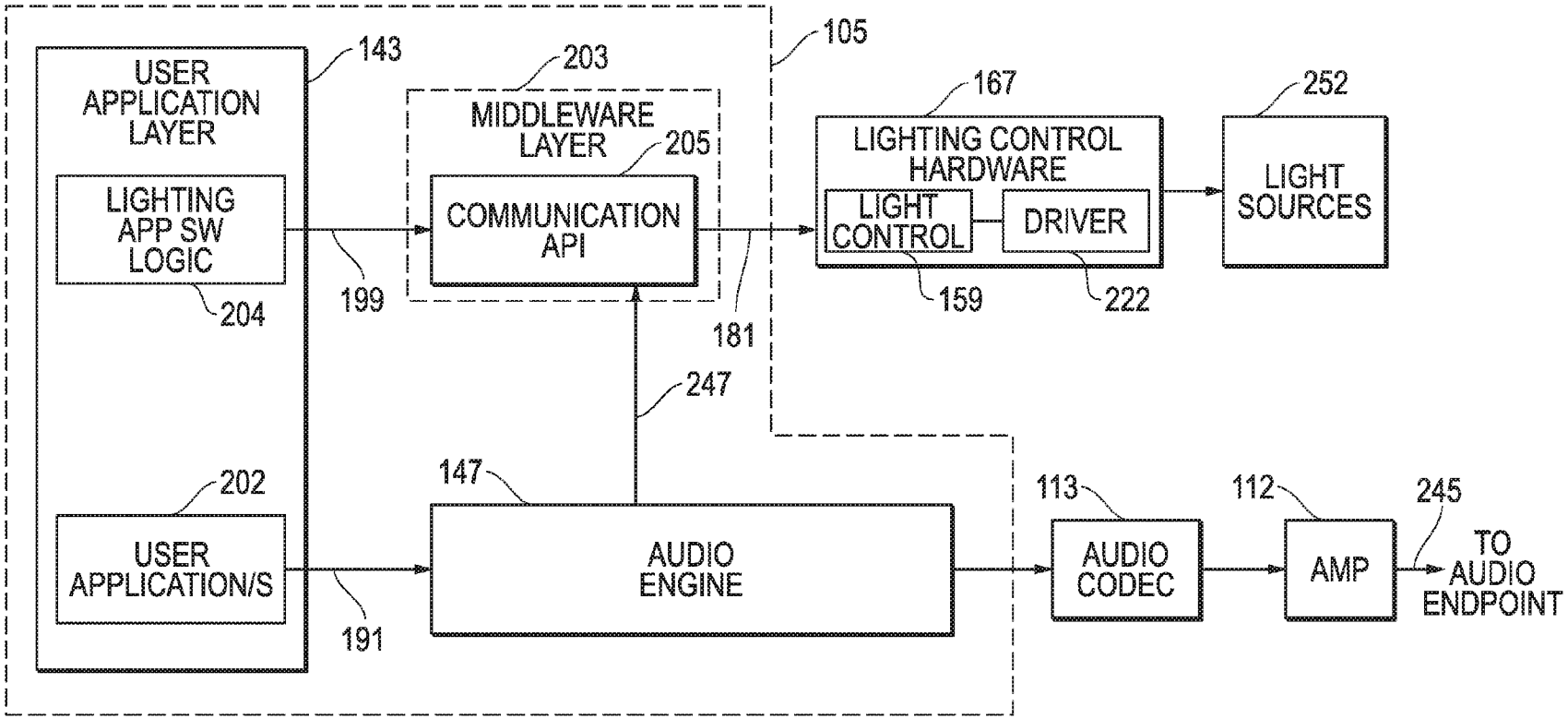
FIG. 2A illustrates a block diagram of audio and light control processing components according to one exemplary embodiment of the disclosed systems and methods.

FIG. 2A is a block diagram illustrating one embodiment of audio and light control processing components that may be implemented with information hardware components of FIG. 1A or 1B, or with other suitable information handling system configurations. As shown, user application layer 143 includes one or more simultaneously-executing Windows-based sound-generating user applications 202 (e.g., such as a computer game or movie applications like Netflix or VLC Player). In this embodiment, applications 202 perform applicable audio format content decoding of stereo or surround sound information to produce a decoded or uncompressed multi-channel audio output stream 191 that is provided to audio processing object (APO) 230 of audio engine 147, which in this embodiment may be configured as part of a Microsoft Windows Driver Model (WDM) audio architecture that produces a multi-channel analog audio output signal 245. However, it will be understood that the disclosed systems and methods may be implemented using other types of audio engine architectures, such as Android Audio Hardware Abstraction Layer, etc. Moreover, it is possible in another embodiment that audio format content decoding may be performed by logic that is separate from application/s 202.

Still referring to FIG. 2A, user application layer 143 also includes a lighting software application 204 that is configured to perform user lighting profile configuration and optional lighting monitoring tasks. One particular example of such a lighting software application 204 is the Alienware Command Center (AWCC) available from Dell Computer of Round Rock, Tex. Such an application control center may include separate user-accessible applications to monitor launching of applications, monitor frequency and/or amplitude of sounds in audio generated by launched user applications, and to allow a user to associate specific system user-defined system configurations and actions with a particular application, e.g., such as Alienware AlienFX configurator software available from Dell Computer of Round Rock, Tex. Once the user selects a sound-generating application and lighting options for a new application lighting profile, the profile configurator that may be provided as a software component of the application control center is responsible for saving the game configuration settings and actions that will be associated with the game/application. Examples of specific user-defined system configurations that may be saved and linked to a particular sound-generating application (e.g., such as a computer game) include specific sound-based keyboard and mouse lighting settings and audio output settings, as well as other possible application settings such as power management settings, performance monitoring recording settings, designated keyboard macros and/or variable pressure key settings and/or macros, etc. In one embodiment, lighting application 204 may be implemented by an application control center such as described in U.S. Pat. No. 9,111,005, which is incorporated herein by reference in its entirety for all purposes.

Figure 3:
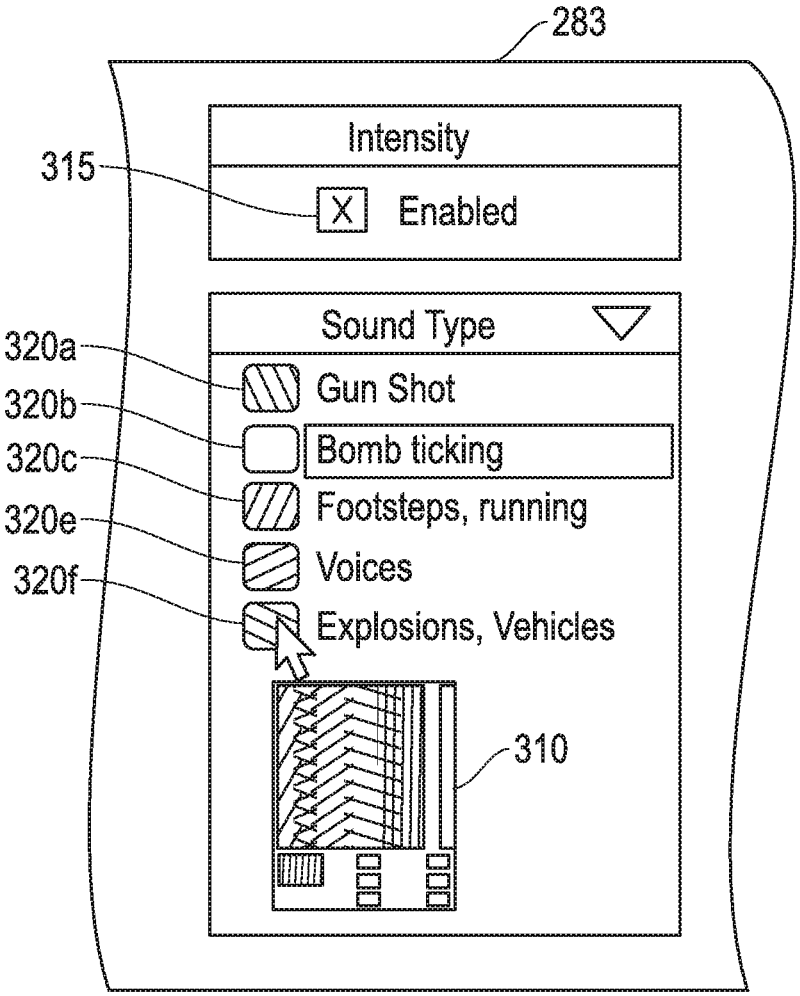
FIG. 3 illustrates a lighting control graphical user interface (GUI) according to one exemplary embodiment of the disclosed systems and methods.

In one embodiment, lighting application 204 may be configured to generate and display a graphical user interface (GUI) 283 of FIG. 3 to a user on at least one of internal display video display 125 or external display 193, and to accept user input from integrated keyboard/touchpad 145 of FIG. 1A or external keyboard/mouse 189 of FIG. 1B. Examples of user-configurable lighting profile options that may be presented to a user by lighting application 204 include, but are not limited to, options for how to use light sources 252 to represent sounds generated by user application/s 202, e.g., user assignment of sound frequency ranges to particular light colors, user assignment of individual light sources 252 to particular light zones, user assignment of particular light zones to respective surround sound channels, user assignment of particular light zones to respective position of sound(s) in 360 degree of space around the user, user assignment of audio loudness to light brightness (luminous) level, etc. A user may select or otherwise specify one or more of these or other options to create user-configurable lighting profile information. Optional lighting monitoring tasks that may be performed by lighting application 204 include, but are not limited to, application launching, notification of system events (e.g., such as system is now in sleep mode, CPU overclocking is active, Antivirus program is currently scanning the hard drive, etc.), notification of in-game events (i.e., explosions, health, etc.), notification that the user is broadcasting or streaming live, etc.

As further shown in FIG. 2A, lighting application 204 may be configured to provide user-created user-configurable lighting profile information (and/or optional user-created lighting monitoring task information) 199 such as described above to a communication application programming interface (API) 205 executing as part of a middleware layer 203 on CPU 105, or in alternative embodiment may be implemented on separate hardware from CPU 105 such as a lighting MCU 111/220, Advanced RISC Machines (ARM)-based digital signal processor (DSP), graphics processing unit (GPU), etc. In another exemplary embodiment, lighting profile information 199 may be predefined and/or otherwise provided from source/s other than a user (e.g., such as predefined by an application developer or publisher, provided by an application 202, etc.) as described elsewhere herein. Communication API 205 is configured to in turn provide API lighting event commands 181 corresponding to the user-configurable lighting profile information provided from lighting application 204 to a hardware layer 167 that may include a lighting control processing device 159 that may be, for example, one of auxiliary embedded controller 111 of FIG. 1A or lighting MCU 220 of FIG. 1B, depending on the embodiment. Auxiliary embedded controller 111 or lighting MCU 220 may then control illumination time, color and luminance of individual light sources 252 (e.g., RGB LEDs) based on the API lighting event commands 181 e.g., via general purpose input/output (GPIO) output signals, Serial Peripheral Interface (SPI) bus or I2C bus signals provided to corresponding light driver/s 222.

Still referring to the exemplary embodiment of FIG. 2A, audio engine 147 may be configured to receive and to perform digital signal processing on multichannel audio stream 191 (e.g., originating from Linear Pulse Code Modulation or decoded DTS Digital Surround, Dolby Digital Plus, or Dolby Atmos, stereo etc.) that in this embodiment is decoded and provided from one or more user application/s 202 that may be simultaneously executing on the information handling system. Multichannel audio stream 191 may include multiple surround sound audio channels for at least one user application 202, such as left channel (L), center channel (C), right channel (R), surround left channel (SL), surround right channel (SR), surround back left channel (SBL), surround back right channel (SBR) in the example of a surround sound 7.1 audio stream 191. As shown, multichannel audio information 247 is provided to communication API 205 for generation of lighting events based on the amplitude and/or frequency of audio information contained in multi-channel audio information 247 and that is based on or otherwise derived from the multichannel audio stream 191. For example as will be described further herein, multichannel audio information 247 may contain audio information only from a selected one or more of individual application/s 202, may contain audio information only from a selected type (or content mode) of application/s 202, and/or may contain combined audio information from all application/s 202.

Figure 2B:
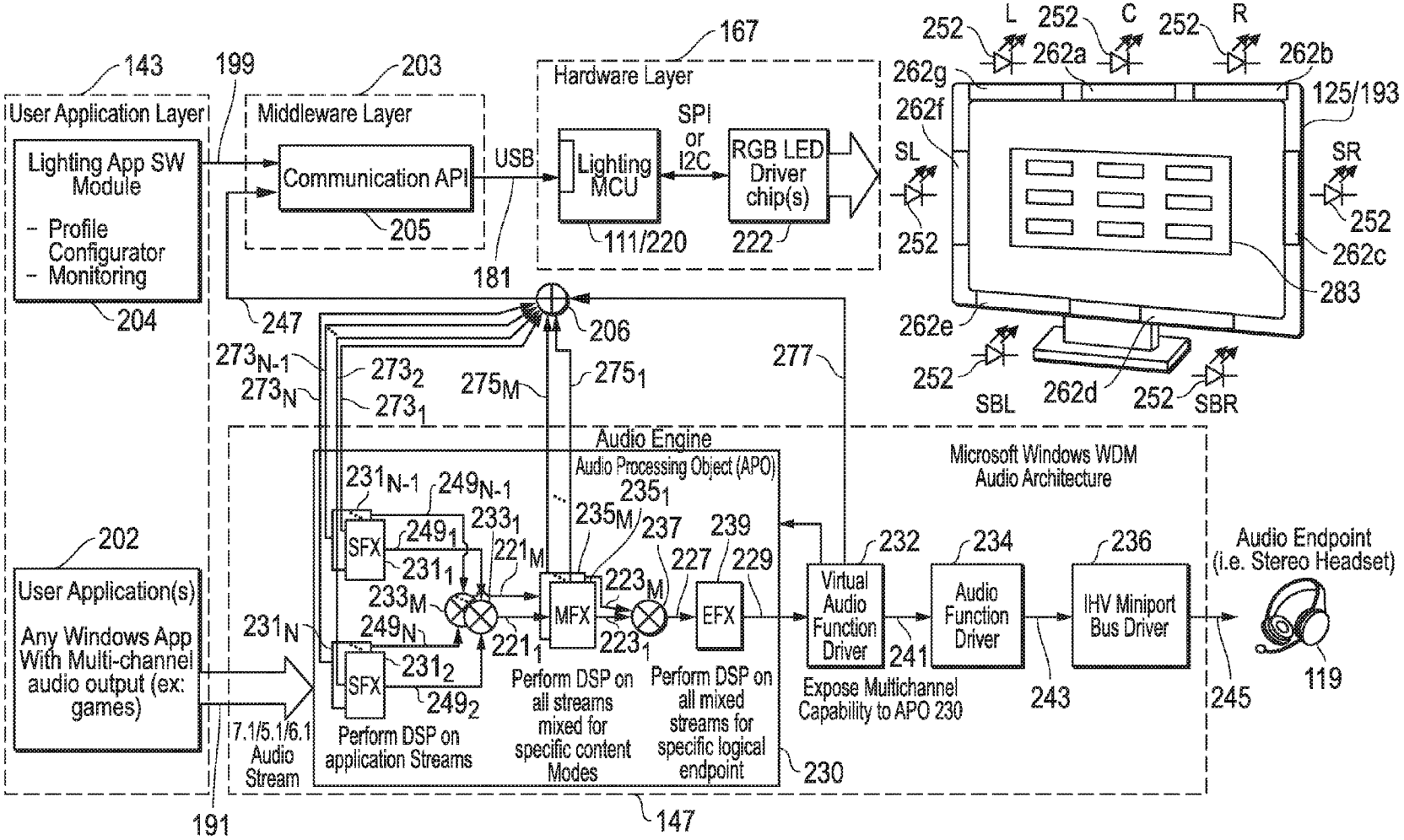
FIG. 2B illustrates a block diagram of audio and light control processing components according to one exemplary embodiment of the disclosed systems and methods.

FIG. 2B illustrates an exemplary embodiment of audio and light control processing components as they may be configured in one exemplary embodiment using Microsoft Windows Driver Model (WDM) audio architecture to produce a multi-channel analog audio output signal 245. In the embodiment of FIG. 2B, audio engine 147 includes at least one user mode software audio processing object (APO) 230 that is configured to receive and to perform digital signal processing on multichannel audio stream 191 (e.g., originating from Linear Pulse Code Modulation or decoded DTS Digital Surround, Dolby Digital Plus, or Dolby Atmos, stereo etc.) that in this embodiment is decoded and provided from one or more user application/s 202 that are simultaneously executing on the information handling system. Multichannel audio stream 191 may include multiple surround sound audio channels for at least one user application 202, such as left channel (L), center channel (C), right channel (R), surround left channel (SL), surround right channel (SR), surround back left channel (SBL), surround back right channel (SBR) in the example of a surround sound 7.1 audio stream 191. As shown in FIG. 2B, APO 230 is configured to detect the audio signal on all channels of the multichannel audio stream 191 in real time, and to report the detected audio information via stream effects (SFX) logic (stream pipe) processing components 231 and/or mode effects (MFX) processing components 235 for selection and use as multi-channel audio information 247, e.g., via a suitable reporting protocol such as component object model (COM) objects. In a further optional embodiment, audio engine 147 may be configured to up-mix received stereo audio channels from a given user application 202 contained in audio stream 191 to surround sound audio channels (e.g., 5.1, 6.1, 7.1, etc.) for that given user application 202 that may then be further processed by components of audio engine 147 in a manner as described elsewhere herein for received surround sound audio streams 191.

In one exemplary embodiment, APO 230 may be further configured to perform standard enhancements when required to augment the audio experience and/or improve sound quality using any algorithm/s suitable for modifying the audio signals of audio stream 191 for content correction (i.e., varying signal levels between different content sources or adding high frequency components back to low resolution audio), loudspeaker correction (i.e., equalization to make the frequency response "flat" or to a desired sound shape), and/or psychoacoustic enhancements (i.e., extra bass sounds by using harmonic distortions based on fundamental frequencies to "trick" the brain into perceiving lower frequencies).

Referring to FIG. 2B in more detail, stream effects (SFX) logic (stream pipe) components 231 of APO 230 are present in this embodiment to extract and separate the multichannel audio stream 191 into individual user application stream pipes $\mathbf{231}_1$ to $\mathbf{231}_N$ that each correspond to a decoded content stream from a respective different user application 202, and to perform optional digital signal processing to produce a SFX output audio stream 249 corresponding to each of the individual separated user application stream pipes $\mathbf{231}_1$ to $\mathbf{231}_N$. Examples of additional types of SFX logic processing that may be performed on the individual stream pipes $\mathbf{231}_1$ to $\mathbf{231}_N$ include, but are not limited to, Frequency Equalizers, Loudness Equalizers, Bass Boost, Environmental Effects, etc.

As shown in FIG. 2B, each of SFX output audio streams $\mathbf{249}_1$ to $\mathbf{249}_N$ may correspond to SFX-processed audio information from a single one of user applications 202 (e.g., a single game application, communication application, movie application, etc.), and may be output from a corresponding one of multiple SFX stream pipe components $\mathbf{231}_1$ to $\mathbf{231}_N$ to one or more of multiple SFX mixer logic components $\mathbf{233}_1$ to $\mathbf{233}_M$ (e.g., value of "M" being different than the value of "N" in one embodiment) where each of the SFX output audio streams 249 may be selected for mixing with other SFX output audio streams 249 in SFX mixer components 233 according to specific content modes, e.g., Default content mode (e.g., for any capture and render streams), Communication content mode (e.g., for applications like Skype), Notification content mode (e.g., Ringtones, alarms, alerts, etc.), Gaming Media content mode (e.g., in-game music), etc. Each of multiple SFX mixer logic components $\mathbf{233}_1$ to $\mathbf{233}_M$ may in turn be present to produce a different respective content mode mixed stream $\mathbf{221}_1$ to $\mathbf{221}_M$ that corresponds to one of the selected content modes and may include a selected portion of multichannel audio stream 191 from one or more user applications 202, representing the selected different content mode. Although FIG. 2B illustrates two SFX output audio streams 249 being received and mixed by each of SFX mixer components 233 to form a corresponding content mode mixed stream 221, it will be understood that it is possible in other embodiments that more than two selected SFX output audio streams 249 may be provided to a given SFX mixer component 233 for mixing together to produce a corresponding content mode mixed stream 221, and/or that only one selected SFX output audio stream 249 may be provided to a given SFX mixer component 233 to produce a corresponding content mode stream 221 that is not mixed.

For example, a first SFX mixer $\mathbf{233}_1$ may be controlled to produce a first content mode mixed stream $\mathbf{221}_1$ that contains only Gaming Media audio information from gaming application SFX output streams $\mathbf{249}_1$ and $\mathbf{249}_2$, while a second SFX mixer $\mathbf{233}_2$ may be controlled to simultaneously produce a different content mode mixed stream $\mathbf{221}_2$ that contains only Communication (e.g., voice communication) audio information from communication application SFX output streams $\mathbf{249}_3$ and $\mathbf{249}_4$, and while another SFX mixer $\mathbf{233}_M$ may be controlled to simultaneously to produce another content mixed stream $\mathbf{221}_M$ from Notification application SFX output streams $\mathbf{249}_{N-1}$ and $\mathbf{249}_N$ that contains only Notification (e.g., email or Windows alarms, alerts) audio information. As will be described further herein, the presence of multiple SFX mixers 233 and/or SFX logic components 231 is optional. In one embodiment, SFX stream pipe components $\mathbf{231}_1$ to $\mathbf{231}_N$ may each be used or selected in order to change audio channel count for a given corresponding mode effects (MFX) processing component 235.

As further shown in FIG. 2B, the processed individual separate user application audio information from SFX stream pipes $\mathbf{231}_1$ to $\mathbf{231}_N$ may be reported as SFX audio information streams $\mathbf{273}_1$ to $\mathbf{273}_N$ (e.g., via a suitable reporting protocol such as component object model (COM) objects) directly to optional selector logic 206 which may be implemented between audio engine 147 and middleware layer 203 by CPU 105 or other separate hardware circuitry. In one embodiment, one or more of separate SFX audio information streams $\mathbf{273}_1$ to $\mathbf{273}_N$ may be selected by selector 206 for processing by communication API 205 to generate lighting events that correspond to sounds extracted from different given user application multichannel audio information originally contained within multi-channel audio stream 191.

For example, stream pipe SFX $\mathbf{231}_1$ may extract and report SFX audio information stream $\mathbf{273}_1$ that contains amplitude and frequency of different audio signals contained in the multi-channel audio information produced by a first user application $\mathbf{202}_1$ (e.g., first person shooter game), stream pipe SFX $231_2$ may extract and report SFX audio information stream $273_2$ that contains amplitude and frequency of different audio signals contained in the multi-channel audio information produced by a first user application $202_2$ (e.g., digital audio music player application), etc. In this example, selector 206 may be controlled to select either one of multiple SFX audio information streams $273_1$ or $273_2$ and provide this selected multi-channel audio information 247 to communication API 205 for generation of lighting events based on the amplitude and/or frequency of the selected SFX audio information streams $273_1$ or $273_2$, or selector 206 may be controlled to select a combination of multiple SFX audio information streams $273_1$ or $273_2$ to allow communication API 205 to generate lighting events based on the combined simultaneous amplitude and/or frequency of the selected multiple SFX audio information streams $273_1$ or $273_2$. In another example, selector 206 may be similarly controlled to select a single SFX audio information stream 273 that corresponds to a gaming application 202 (e.g., first person shooter game) for generation of lighting events by communication API 205, while excluding SFX audio information stream/s 273 that correspond to audio stream information produced from a simultaneously executing movie application 202 and/or from a voice communication application 202 (e.g., such as Skype).

Still referring to FIG. 2B, a different content mode mixed stream 221 may be provided from each one of respective different SFX mixers $233_1$ to $233_M$ to one of corresponding mode effects (MFX) processing components $235_1$ to $235_M$. Each given one of MFX processing components $235_1$ to $235_M$ may in turn perform digital signal processing on all user application audio stream information that has been mixed for the specific content mode of the given MFX processing component 235. Examples of types of MFX logic processing that may be performed on a given content mode mixed stream 221 include, but are not limited to, Frequency Equalizers, Loudness Equalizers, Bass Boost, Environmental Effects, Dynamic Range Compression, etc. Examples of such specific content modes (and possible MFX processing assignments) include, but are not limited to, MFX $235_1$=Default (e.g., for any capture and render streams), MFX $235_2$=Communication (e.g., for applications like Skype), MFX $235_3$=Notification (e.g., Ringtones, alarms, alerts, etc.), MFX $235_4$=Gaming Media (e.g., In game music), etc.

As shown, each MFX processing component 235 may provide its corresponding MFX processed audio information 275 (i.e., corresponding to its particular content mode such as Gaming Media audio information, Communication audio information, Notification audio information, Movie audio information, etc.) to selector logic 206 where one or more streams $275_1$ to $275_M$ of MFX processed audio information $235_1$ to $235_M$ may be selected and provided as multi-channel audio information 247 communication API 205 for generation of corresponding lighting events based on the selected MFX processed audio information 275 output from one or more MFX processing components 235. As further shown, a different MFX-processed mixed stream 223 may also be provided from each corresponding MFX processing component $235_1$ to $235_M$ to MFX mixer logic 237 that is configured to combine the separate MFX-processed mixed streams $223_1$ to $223_M$ corresponding to the different content modes, prior to providing a combined mixed stream 227 to endpoint effects (EFX) processing logic 239.

In the embodiment of FIG. 2B, EFX processing logic component 239 is provided to perform any required digital signal processing on combined mixed audio stream 227 for a specific logical audio endpoint 119, such as notebook PC internal speakers, line-out jack that can be connected to a set of external speakers or set of headphones, etc. In the illustrated embodiment, EFX component 239 may be configured to identify capabilities of currently coupled audio endpoint/s 119 by querying and receiving audio input capability information reported by Audio Function driver 234, and to thus determine compatibility of the current available audio endpoint/s 119 with the type of multichannel audio information present in combined mixed stream 227. EFX component 239 in turn produces a processed APO output audio stream 229 that includes all SFX and MFX processing, and that is compatible with the reported capabilities (e.g., stereo, type of surround-sound, etc.) of audio endpoint/s 119. One example of EFX processing by EFX processing logic component 239 is speaker protection that may include use of a high pass filter in EFX processing logic component 239 to attenuate raw audio energy for output to an audio endpoint (e.g., single audio speaker) that cannot handle the full raw energy of the audio output stream.

APO output audio stream 229 is then provided from APO 230 to optional virtual audio function driver 232 which may be configured in one embodiment to expose multi-channel capability to APO 230, e.g., by reporting to APO 230 that a multi-channel capable audio endpoint device 119 exists (regardless if the actual capabilities of audio endpoint 119) so that all audio channels (e.g., all stereo, 5.1, 6.1 and/or 7.1 surround channels as may be the case) are always output by EFX processing component 239 and are available in the APO output stream 229 that is output by APO 230 so that they may be used to generate lighting events. For example, virtual audio driver 232 may report to APO 230 that the current audio endpoint 119 is capable of receiving all possible surround sound audio channels even in a case where the actual physical audio endpoint device 119 only supports a reduced number of channels (e.g., such as only two stereo channels or only a mono channel) or even in the case where no audio endpoint device 119 is present. In such an example, EFX processing component 239 will produce an EFX-processed APO output stream 229 that is processed where required to include all surround sound audio information despite the actual capabilities of audio endpoint 119. This allows, for example, all available surround sound channels to be used for generating multi-positioned generating lighting events, even while audio endpoint device 119 is only capable of producing stereo sound to a user.

When present, virtual audio function driver 232 may receive APO out stream signal 229 to produce a corresponding endpoint audio stream 241 that has been EFX processed where required and that is provided to audio function driver 234 (e.g., kernel mode software miniport driver or adapter driver). As shown, virtual audio function driver 232 may also be configured to provide combined content mode audio information 277 in real time to selector logic 206 as shown. In an alternate embodiment, when virtual audio function driver 232 is absent, an unprocessed audio stream may be provided from APO 230 directly to audio function driver 234. In either embodiment, audio function driver 234 may be present to pass audio stream 243 to independent hardware vendor (IHV) miniport audio drivers 236 that may be present to control access to hardware of audio endpoint 119, e.g., via Windows HDA audio bus/es for integrated audio and external devices such as USB audio devices, Bluetooth audio devices, HDMI audio, etc. Digital to analog converter (DAC) logic and amplifier circuitry may also be present to output analog audio signal 245 that includes audio information from the combined content modes of all MFX processing components, and which may be provided from audio engine 147 to one or more optional audio endpoints 119 which may or may not be present.

Selector 206 of FIG. 2B is present to select between SFX processed audio information streams $\mathbf{273}_1$ to $\mathbf{273}_N$, MFX processed audio information $\mathbf{275}_1$ to $\mathbf{275}_M$, and/or combined content mode audio information 277 for input as selected multi-channel audio information 247 to communication API 205 that is executing as part of middleware layer 203. In this regard, selector 206 may be controlled to select any combination of one or more SFX processed audio information streams $\mathbf{273}_1$ to $\mathbf{273}_N$, one or more MFX processed audio information $\mathbf{275}_1$ to $\mathbf{275}_M$, and combined content mode audio information 277 for combination and simultaneous input as selected lighting event audio information 247 to communication API 205.

In one embodiment, selector 206 may be controlled by user input to lighting application 204, e.g., and conveyed by lighting profile information 199 in response to user input commands via GUI display. In another embodiment, selector 206 may be automatically controlled by lighting application software logic 204 based on current state and/or identity of currently executing user applications 202 and/or previously defined lighting profile information 199. Communication API 205 may be configured to in turn translate multi-channel audio information 247 into lighting event commands 181 to cause illumination of selected light source zones 262 or locations of display 125/193 of keyboard 145 for the duration of corresponding lighting event occurrences. Communication API 205 may perform this task by mapping each discrete channel (e.g., center channel, left front channel, etc.) of the selected multi-channel audio information 247 to illuminate lighting source/s 252 of particular and/or predefined display (or alternatively keyboard 145) lighting zones 262 according to user lighting profile configuration information.

For example, in one exemplary embodiment, selector 206 may be controlled (e.g., by user input via lighting application software logic 204 or automatically by lighting application software logic 204 itself) to select a SFX audio information stream 273 corresponding to a given software application 202 that is in focus, although other software applications 202 that are not currently in focus may be alternatively or additionally selected. It is also possible that a combination of SFX audio information streams 273 may be simultaneously selected in order to generate lighting event commands 181 to cause illumination of selected light sources or zones based on combined audio information from multiple executing applications 202. Such user lighting profile configuration information may be selected or otherwise input by a user or other source to lighting software application 204 and then stored in non-volatile memory 127, non-volatile memory 107, system memory 115, and/or system storage 135 of the information handling system of FIG. 1A or 1B.

FIG. 2B illustrates a display 125/193 having seven available lighting zones 262*a* to 262*g* (e.g., which may each include one or more light sources, such as RGB LEDs) that are provided to allow a different lighting zone 262 to be assigned to each audio channel of surround sound 7.1 audio stream, it being understood that more or less than seven available lighting zones may be provided in other embodiments. Lighting zones 262 of FIG. 2B are illustrated having an outline in the shape of a "bar" or rectangle, it being understood that any other shape of lighting zones 262 (square, circular, diamond, irregular, etc.) may be employed.

Figure 2C:
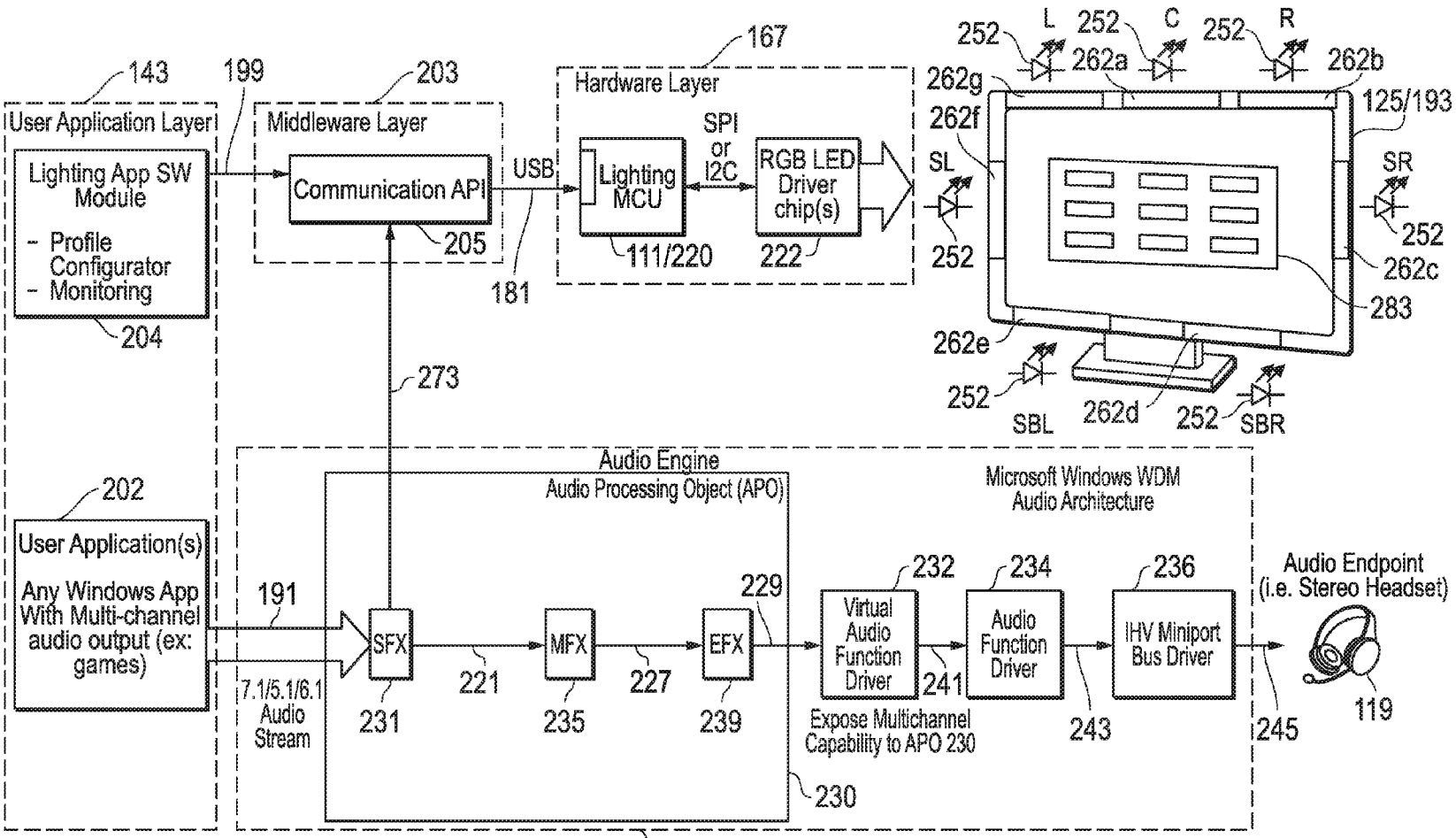
FIG. 2C illustrates a block diagram of audio and light control processing components according to one exemplary embodiment of the disclosed systems and methods.
Figure 2D:
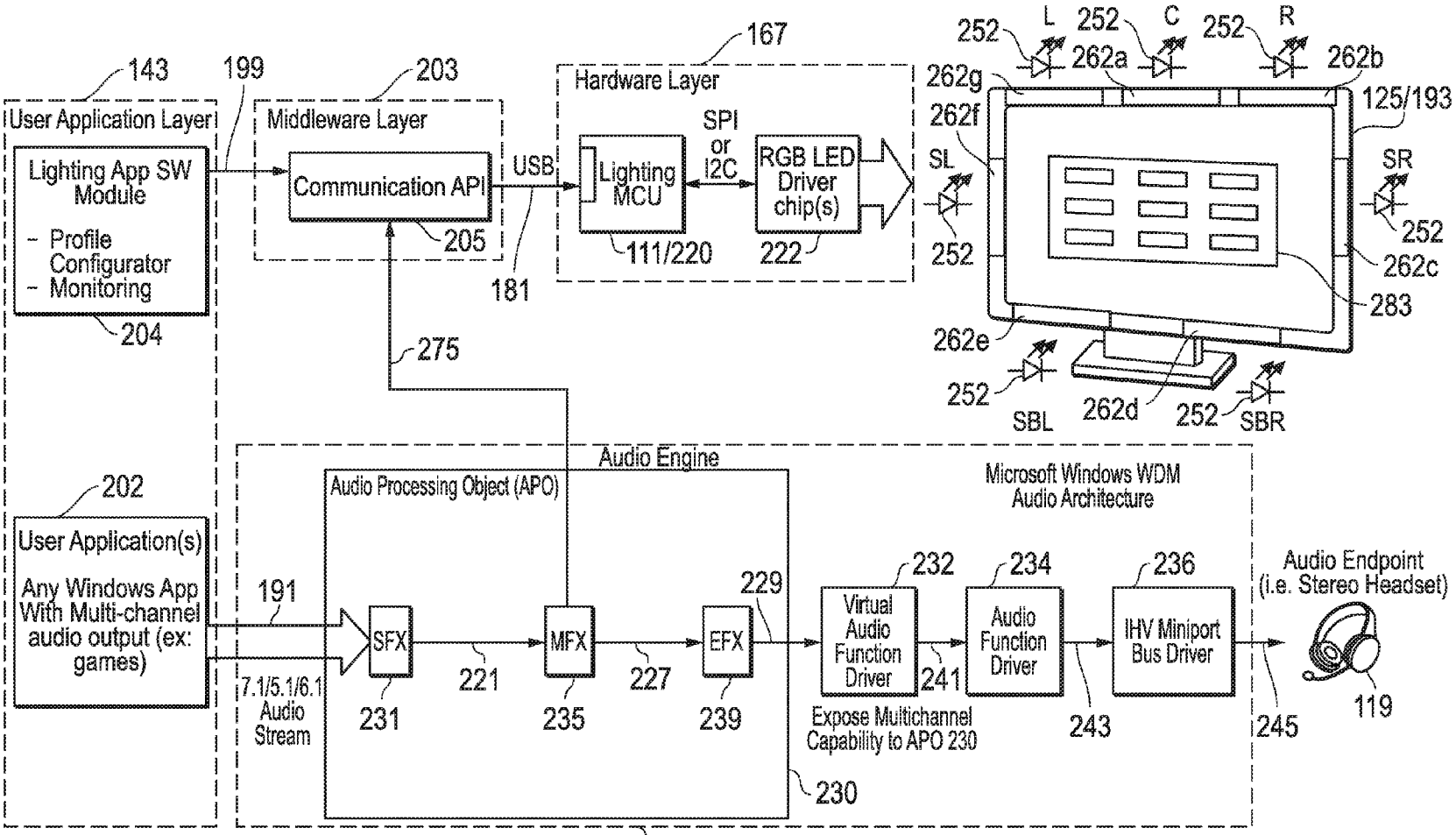
FIG. 2D illustrates a block diagram of audio and light control processing components according to one exemplary embodiment of the disclosed systems and methods.
Figure 2E:
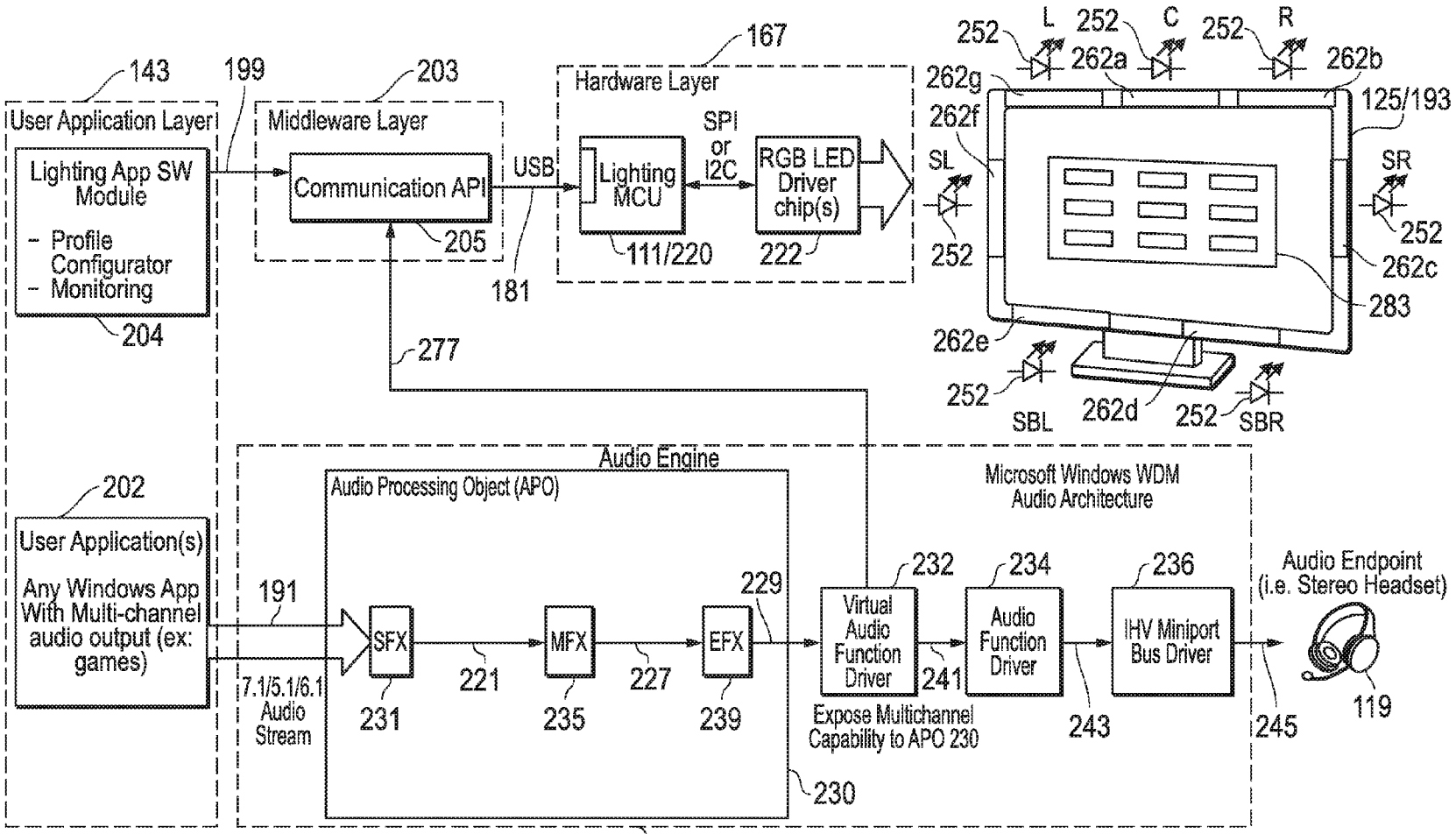
FIG. 2E illustrates a block diagram of audio and light control processing components according to one exemplary embodiment of the disclosed systems and methods.

It will be understood that the exemplary embodiment of FIG. 2B is exemplary only, and that other embodiments are possible. For example, FIGS. 2C, 2D and 2E illustrate alternative embodiments that do not include selector logic 206, but rather are configured to utilize one of combined SFX processed audio information 273 from all SFX processing components 231 (FIG. 2C), combined MFX processed audio information 275 from all MFX processing components 235 (FIG. 2D), or content mode audio information 277 from virtual function audio driver 232 (FIG. 2E), respectively. In FIGS. 2C-2E, the multiple instances of SFX processing components 231, multiple instances of MFX processing components 235 and multiple combiners 233 are not illustrated for purposes of simplicity, but may be configured to operate in a manner as described elsewhere herein.

Figure 4A:
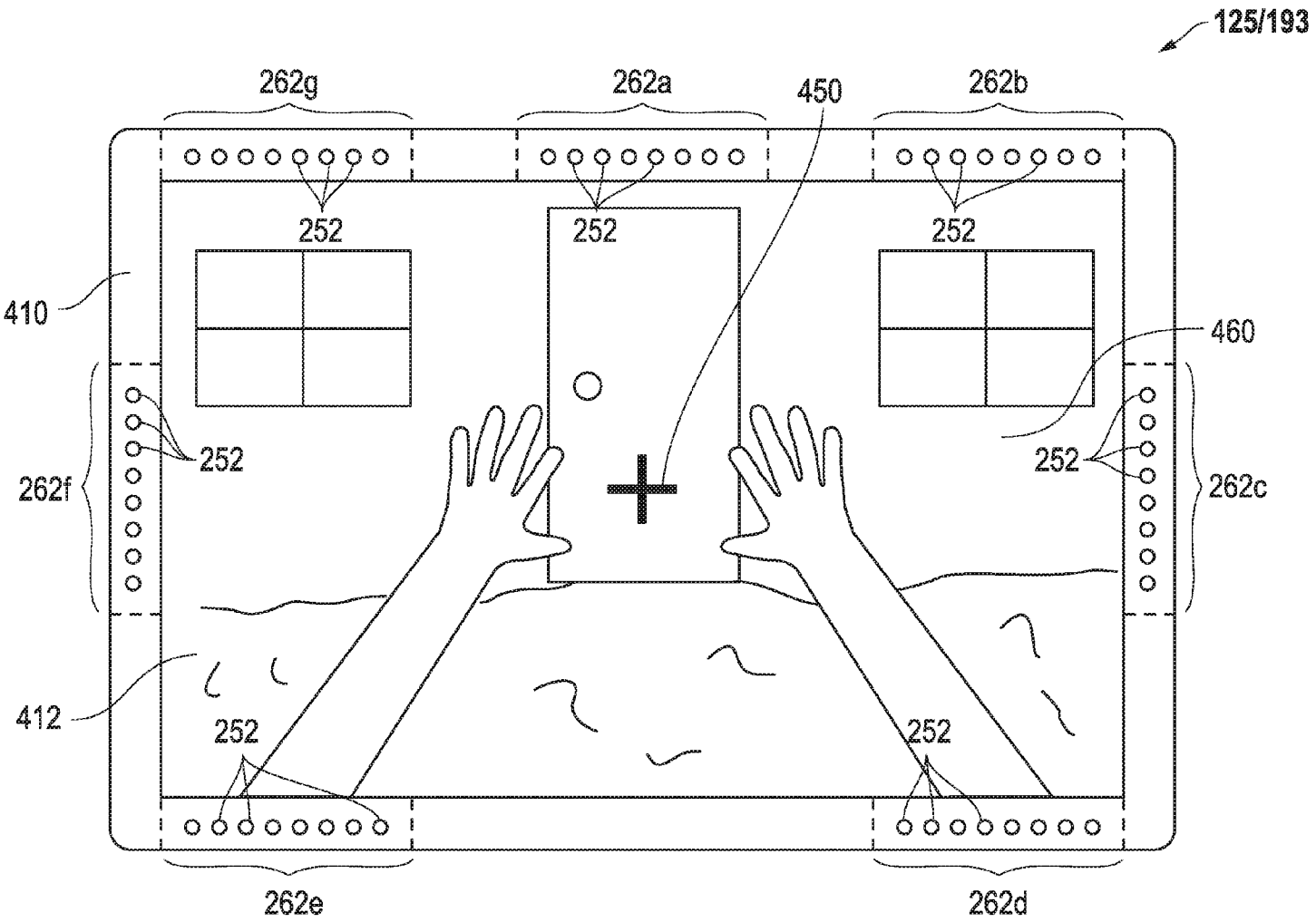
FIG. 4A illustrates a display device according to one exemplary embodiment of the disclosed systems and methods.

FIG. 4A further illustrates one exemplary display embodiment in which each lighting zone 262*a* to 262*g* includes a group of individual light sources 252, such as RGB LED light elements integrated into a bezel area 410 of the display 125/193 around the graphics display area 412. It will be understood that the seven zone embodiment of FIGS. 2 and 4A could alternatively be employed audio streams having greater or less than seven channels and that all available lighting zones 262 need not be assigned to a channel in every case, and/or that groups of two or more available lighting zones may be assigned to a single audio channel. For example, surround sound 5.1, and surround sound 6.1 audio streams may be mapped to only a selected five or six of the available seven zones 262 respectively, a right stereo channel may be mapped to a group of lighting zones 262*b*, 262*c*, and 262*d* while a left stereo channel may be mapped to a group of lighting zones 262*e*, 262*f*, and 262*g*, etc. Selection of such mapping options may be input, for example, by user input to lighting application 204.

Also shown in FIG. 4A is a graphics scene 460 (e.g., battlefield area) as it may be generated in first person view by a user application 202 (e.g., first person shooter application) and displayed by one of GPUs 109 or 120 on the graphics display area 412 of display 125/193. In such an example, the same user application 202 may simultaneously generate accompanying in-game sounds (e.g., gunshots, footsteps, explosions, voices, etc.) using multi-channel audio stream 191 that is referenced to the real time virtual point of reference 450 that represents the user's virtual position within the space of scene 460 such that the individual in-game sounds are each generated using an audio stream channel that corresponds to the direction of the sound's origin within the scene 460 relative to the user's virtual position or point of reference 450, e.g., left channel corresponding to a sound originating to the front and to the left of the user's position 450, center channel corresponding to a sound originating directly in front of the user's position 450, surround back right channel corresponding to a sound originating directly behind the user's position 450, etc. In the case of display area 412, each of the different light zones 262 are positioned on display device 125/193 in a different direction from a selected point of reference for display device 125/193 that in this case corresponds to the virtual point of reference 450 of the application scene as it is displayed on the display device 125/193.

Figure 4B:
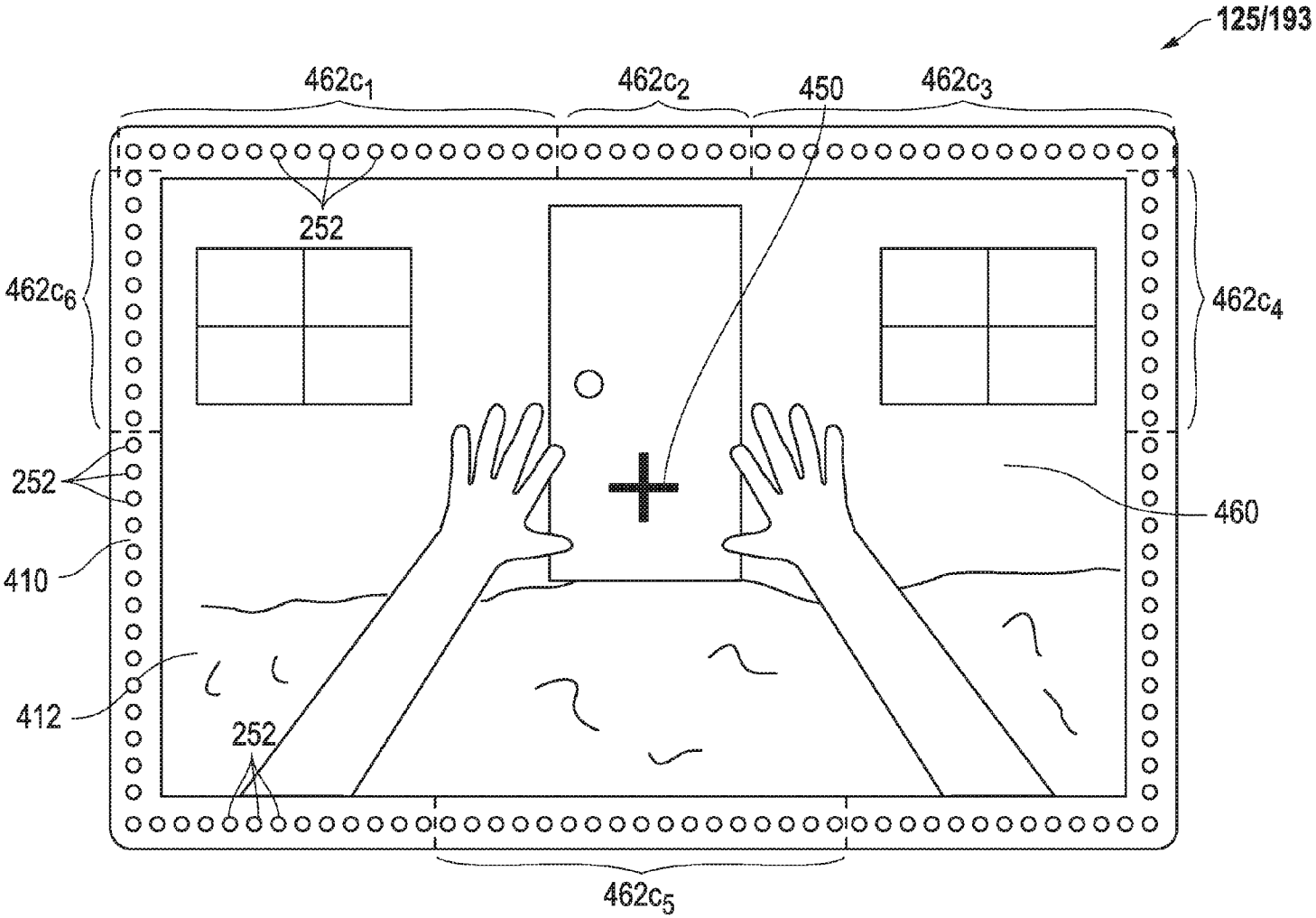
FIG. 4B illustrates a display device according to one exemplary embodiment of the disclosed systems and methods.

FIG. 4B illustrates another exemplary embodiment of display 125/193 in which multiple individually-addressable light sources 252 (e.g., RGB LEDs) may be provided within the bezel area 410 in a continuous pattern around the perimeter of the display area 412, it being understood that although one continuous row of light sources 252 is illustrated in FIG. 4B, that multiple rows of such light sources 252 may be alternatively provided in similar manner. In such an embodiment, lighting application 204 may be used to allow a user to assign and configure multiple custom lighting zones 462*c*, e.g., to match the number of surround sound audio channels actually available, or to create lighting zones that are custom placed around the bezel 410 at user-designated positions or positioned by lighting event commands 181 provided by the API 205 and/or with user-designated sizes or number of lighting sources for each zone. Such customized zones may employed in one embodiment to illuminate individual-addressable light sources 252 to show the user a more precise angle of trajectory of the direction where a given sound event of a given audio channel is coming from.

Returning now to FIG. 2B, once permanently stored (in non-volatile memory 127/107 or system storage 135) or temporarily stored (e.g., in system memory 115), communication API 205 of middleware layer 203 may be configured to access/retrieve and use the stored lighting profile configuration information to produce lighting event commands 181 to lighting MCU 111/220 to cause lighting MCU 111/220 to control the corresponding light driver/s 222 to illuminate the assigned lighting sources 252 of each predefined lighting zone that corresponds to the selected surround sound channel according to the user lighting profile configuration information defined for a given software application 202 that is producing multi-channel audio stream 191. This may correspond to an application that is currently in focus that is producing multi-channel audio stream 191, or in one embodiment may be any other selected currently-executing application/s 202, whether or not currently in focus.

Table 1 illustrates an example lookup table of lighting profile configuration information that may be employed to map seven individual defined bezel lighting zones 262*a* to 262*g* of a display lighting layout of FIG. 2B and FIG. 4A (e.g., for integrated display device 125 or external display device 193) to particular discrete surround sound 7.1 channels of the selected multi-channel audio information 247. It will be understood that such lighting profile configuration information may be user-defined, pre-defined by Game Developer or Publisher or particular application 202, etc. and in one embodiment may be provided as lighting profile information 199 to communication API 205. Similar look up tables or other suitable data structures may be employed (e.g., as lighting profile information 199) to define or map selected light colors to assigned sound frequencies for a given channel and assigned lighting zone, to define or map selected displayed light intensity levels to corresponding assigned sound amplitude ranges for a given channel and/or assigned lighting zone, to define or map selected displayed light colors to corresponding assigned sound amplitude ranges for a given channel and/or assigned lighting zone, to define or map selected displayed light intensity levels to corresponding assigned different sound types, to identify or map a set of individual lighting sources 252 to a given display bezel lighting zone, etc. It will also be understood that a similar type of look up table or other suitable data structure may be employed to define lighting profile configuration information (e.g., as lighting profile information 199) for other types of internal or external device lighting, e.g., such as lighting sources 252 provided on keyboard/mouse 189, keyboard/touchpad 145, etc.

TABLE 1

| Surround Sound Channel | Assigned Display Bezel Lighting Zone for the Surround Sound Channel |
|---|---|
| L = Left Channel | Top Left |
| C = Center Channel | Top Center |
| R = Right Channel | Top Right |
| SL = Surround Left Channel | Middle Left |
| SR = Surround Right Channel | Middle Right |
| SBL = Surround Back Left Channel | Bottom Left |
| SBR = Surround Back Right Channel | Bottom Right |

FIG. 3 illustrates one exemplary embodiment of a lighting control graphical user interface (GUI) 283 that may be generated by lighting application 204 for display to a user on at least one of internal display video display 125 or external display 193. In the embodiment of FIG. 3, GUI 283 may allow a user to input selections to lighting application 204 to enable or disable display of varying component light intensity for corresponding different sound amplitudes in audio stream 191 of a given application 202 by checking or unchecking box 315, respectively. In this embodiment, GUI 283 also allows a user to input profile configuration information to lighting application 204 for the given application 202 in focus in order to select which "Sound Types" (corresponding to either different sound frequency ranges or by recognition of sound signatures) to display, e.g., which are represented in this include sound types 320*a* to 320*e* that correspond to "Gun Shot", "Bomb Ticking", "Footsteps, Running", "Voices" and "Explosions, Vehicles". As shown, GUI 283 of this embodiment also allows the user to select and assign desired RGB LED lighting colors from a color palette 310 to the sound types that have been selected for display. For purposes of illustration here, different colors are represented by different cross-hatching patterns. However, it will be understood that in reality, the actual colors of the color palette and color box selections would be displayed on video display 125 or 193. It is noted that in FIG. 3, the "Bomb Ticking" sound type 320*b* has not been selected for display by the user, i.e., no color has been assigned to the "Bomb Ticking" box 320*b*. Thus, the sound frequency range corresponding to this sound will not be displayed if and when it occurs in the selected multi-channel audio information 247.

Table 2 below illustrates an exemplary embodiment of lookup table of lighting profile configuration information that may be created by lighting application 204 to define and/or store different sound types and corresponding sound frequency ranges and or sound signatures mapped to assigned lighting component colors in response to user selection made using GUI 283 of FIG. 3, and which in one embodiment may be provided as lighting profile information 199 to communication API 205. It will also be understood that the particular different frequency ranges and/or sound signatures corresponding to different Sound Types may be pre-defined by default or alternatively may be entered into Table 2 by a user via a GUI or any other suitable data input mechanism. In Table 2, different frequency range values (e.g., in this case in kilohertz) have been predefined (or alternatively user-entered) into Table 2, and sound signatures for particular game sounds (e.g., helicopter, footsteps, gun shots, etc.) are pre-stored data or files that come with the application, and "yyyyyyy" values represent the hex code for red/green/blue (RRGGBB) color assignment to any given RGB LED or lighting device 252 that correspond to the user color palette selection for each individual sound type. Intensity is indicated as "Yes" for enabled where a user checkbox is checked in GUI 283, it being understood that in another embodiment individual intensity checkboxes may be provided for selectively enabling lighting luminous intensity representing sound amplitude for different Sound Types, for different Lighting Zones, etc. Communication API 205 may analyze selected multi-channel audio information 247 (e.g., using bandpass filtering and/or signature analysis) to identify the frequency range content or sound type identification of a given lighting event reported to middleware layer 203.

TABLE 2

| Sound Type | Frequency Range | List of Sound Signatures (Spectrum Analysis Signature) | Hex Color Code for Identified Sound Type (RRGGBB) | Luminous Intensity for Loudness Enabled |
|---|---|---|---|---|
| Bass | 20-250 Hz | | FF0000 (red) | No |
| Mid-Range | 251-2.6 KHz | | 0011FF (blue) | No |
| Treble | 2.61-20 KHz | | 00FF00 (green) | No |
| Gun Shot | | GunShotSig | EA7424 (orange) | Yes |
| Bomb Ticking | | BombSig | 09B3A7 (Teal) | No |
| Footsteps Running | | FootstepSig | B0E0E6 (Light Blue) | Yes |
| Voices | | VoiceSig | 79CE16 (Lime Green) | No |
| Explosions, Vehicles | | ExplosVehSig | EEB84C (Gold) | Yes |

In one embodiment, lighting application 204 may be utilized to characterize and map different sound types to predefined frequency spectrum analysis signatures. For example, communication API 205 may perform real time frequency spectrum analysis of selected multi-channel audio information 247, for example, by using Fast Fourier Transform (FFT), discrete cosine transform (DCT) and/or Discrete Tchebichef Transform (DTT) processing implemented in middleware layer 203 to analyze a real time frequency spectrum of one or more audio channels contained in multi-channel audio information 247. Communication API 205 may then match the real time frequency spectrum generated for each channel of selected multi-channel audio information 247 to a corresponding one of the predefined frequency spectrum analysis signatures (e.g., FootstepSig) provided by lighting application 204 (e.g., in lookup Table 2 of lighting profile information 199). Communication API 205 may then determine the current sound type (e.g., "Footsteps Running") corresponding to the matched frequency spectrum analysis signature (e.g., FootstepSig) for the analyzed audio channel from the lookup table.

It will be understood that Table 2 and FIG. 3 are exemplary only and that additional or fewer sound frequency ranges and/or sound types may be assigned a corresponding lighting display color, and/or that different values and units may be employed as appropriate for a given application. Further, other GUI configurations may be employed for user configuration of lighting colors and/or other types of lighting configuration parameters such as assigning lighting intensity sound amplitude (e.g., decibel) ranges, assigning individual lighting sources 252 to different lighting zones and/or assigning individual lighting zones to different surround sound channels, etc.

Figure 4C:
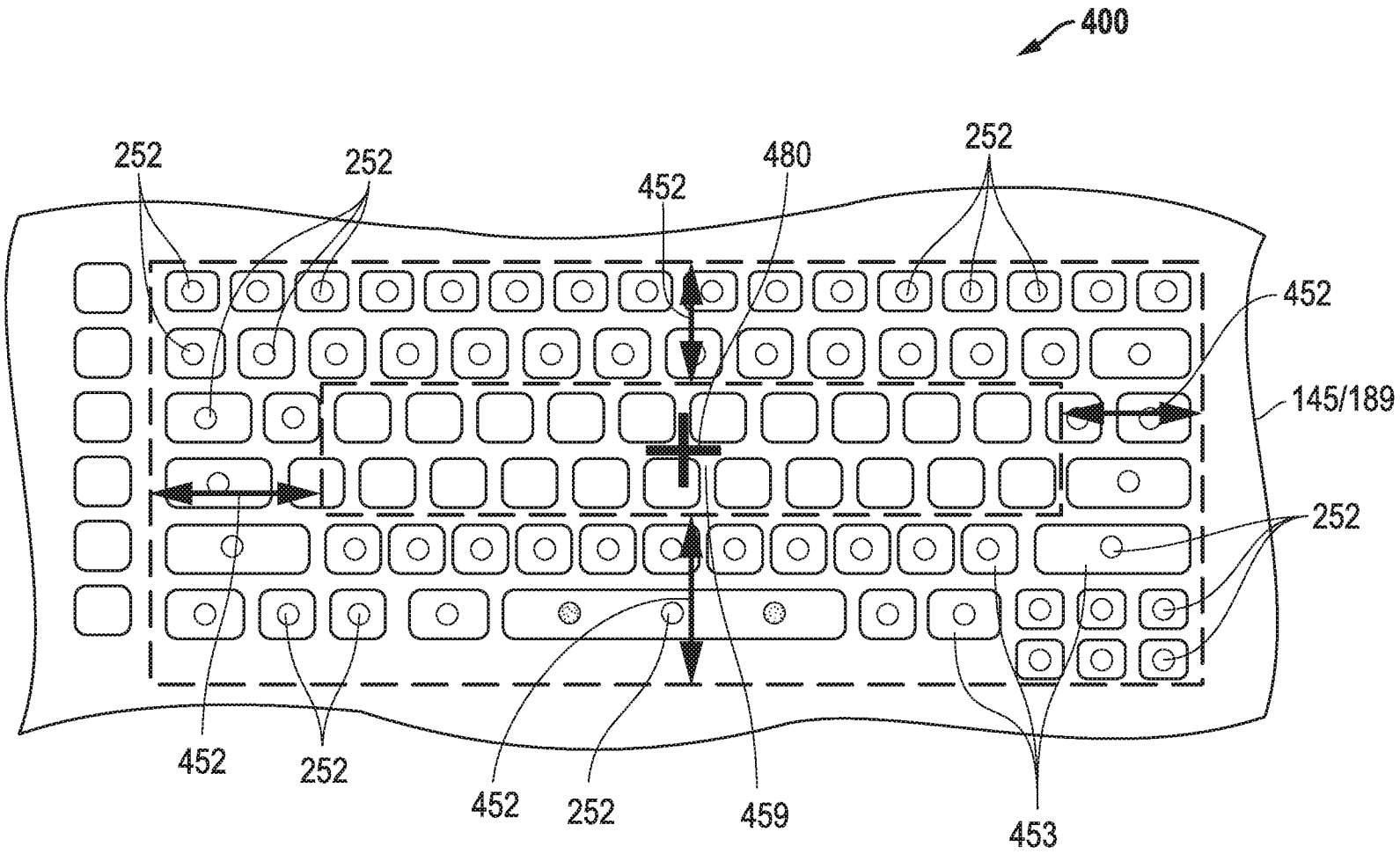
FIG. 4C illustrates a keyboard layout according to one exemplary embodiment of the disclosed systems and methods.

FIG. 4C illustrates one exemplary embodiment of a keyboard layout 400 that may be implemented, for example, with an integrated keyboard 145 or external keyboard 189. In this exemplary embodiment, at least a portion of the individual keys 453 may each be a lighted key that is provided with its own controllable lighting source 252 (e.g., such as one or more integral RGB LEDs or individual RGB LEDs connected to each key with or without a respective light pipe), it being understood that in another embodiment multiple adjacent keys may be illuminated by one or more common light sources 252. Each of the lighted keys 453 may be configured in any suitable manner (e.g., with a translucent key cap, with or without an integral light pipe at the key cap upper surface, with a LED mounted in the key cap upper surface, etc.) to allow light from its given light source 252 project upward from the key to a keyboard user. In this exemplary embodiment of FIG. 4C, a lighted key region 452 may be defined to include peripheral rows of lighted keys 453 (each key having individual or shared lighting sources 252) around a center section 459 of non-lighted keys that may either not be lighted at all or that may optionally not be employed for multi-channel audio positional lighting. Examples of keyboard lighting technology and lighting techniques that may be utilized with the features of the disclosed systems and methods may be found, for example, in U.S. Pat. No. 7,772,987, U.S. Pat. No. 8,411,029, U.S. Pat. No. 9,368,300, and United States Patent Publication No. 2015/0196844A1, each of which is incorporated herein by reference in its entirety.

Figure 5:
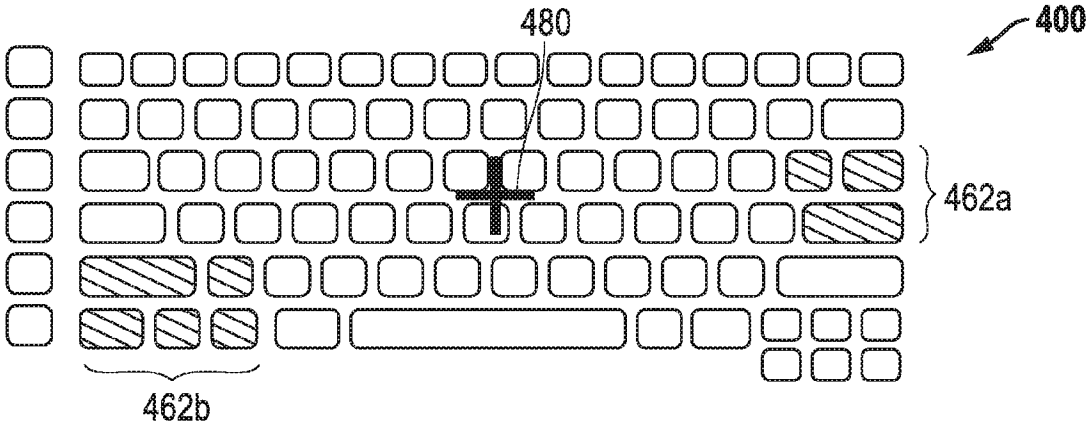
FIG. 5 illustrates a keyboard layout according to one exemplary embodiment of the disclosed systems and methods.
Figure 6:
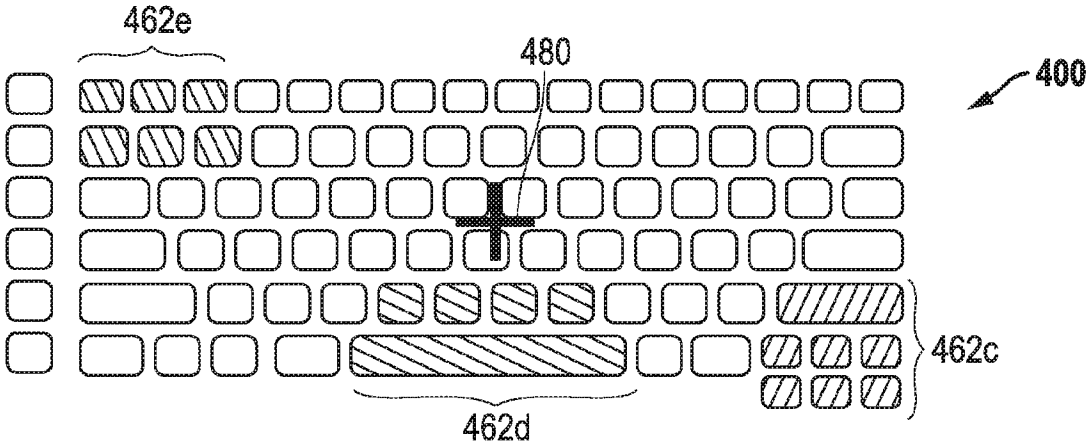
FIG. 6 illustrates a keyboard layout according to one exemplary embodiment of the disclosed systems and methods.
Figure 7:
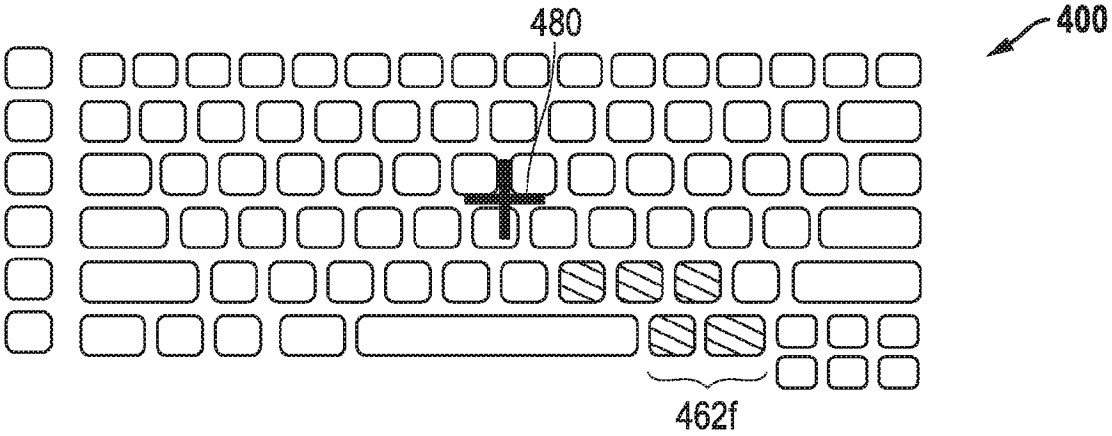
FIG. 7 illustrates a keyboard layout according to one exemplary embodiment of the disclosed systems and methods.

In the embodiment of FIG. 4C, lighted keys of lighted key region 452 may be configured by lighting application 204 and controlled by communication API 205 to be selectively illuminated to indicate sound direction, sound amplitude (or sound intensity), and/or sound type (e.g., using spectral analysis or bandpass filtering) to a user in a manner similar to that described for displays 125 and 193 herein. In the embodiment of FIG. 4C, directional and colored lighting may be employed to light up keys 453 anywhere around the two-key wide peripheral region 452 of the keyboard layout 400. For example, FIGS. 5-7 illustrate how multi-channel audio positional lighting may be employed to indicate direction, amplitude/intensity, and type of sounds generated by a user application 202 to a user in 360 degree space around the center section 459 of keyboard layout 400 (assuming the virtual position or point of reference 450 of the user within the application space is represented by the selected point 480 of the keyboard center section 459 that is selected (e.g., mapped) to correspond to the virtual point of reference 450 of the application scene). In FIGS. 5-8, sound type is indicated by different colors as assigned using GUI 283 described in relation to FIG. 3. It will be understood that a similar methodology may be employed using the integrated or external display lighting zones 262 of FIGS. 2, 4A and 4B.

FIG. 5 illustrates real time simultaneous blue illumination of two lighting zones 462*a* and 462*b* in response to the recognized sound of explosions coming simultaneously from surround right channel and surround back left channel, respectively, that are received together in selected multi-channel audio information 247 currently provided to communication API 205. Each of lighting zones 462*a* and 462*b* remains so illuminated for the duration of its corresponding and recognized signature of an explosion sound, and then goes dark when the sound ceases. Thus, the user is visually aware of the type of sounds occurring, the time and duration of these sounds, and the direction from where these sounds originate relative to the user's virtual position or point of reference perspective within the "soundstage" or virtual space of the scene currently displayed by the user application 202 (e.g., a user's first person virtual point of reference position within a first person game like a first person shooter game such as "Call of Duty").

FIG. 6 illustrates simultaneous real time illumination of three lighting zones 462*c*, 462*d* and 462*e* in different colors in response to simultaneous footstep sounds (red lit right rear zone 462*c* having a position based on surround rear right channel), explosion sounds (blue lit rear center zone 462*d* having a position that is interpolated between surround rear left and rear right channels) and gunshot sounds (green lit front left zone 462*e* having a position determined from surround front left channel), that are received together in selected multi-channel audio information 247 currently provided to communication API 205.

FIG. 7 illustrates real time blue illumination of a single lighting zone 462*f* in response to explosion sound coming from slightly off left from surround back right channel (position interpolated between surround rear left and right channels) that is received in selected multi-channel audio information 247 currently provided to communication API 205. In FIG. 7, the origin of the explosion sound is behind and just to the right of the user's position within the application soundstage. In one embodiment, FIG. 7, may represent a situation where the explosion of lighting zone 462*f* is the only sound currently occurring. However, in another exemplary embodiment, a user may select to only display the position and sound type of the loudest sound being currently output in any channel of the multi-channel audio information 247 at a given time. In such an embodiment, the explosion of lighting zone 462*f* may be identified as the loudest sound being currently output in multi-channel audio information 247 (even though many different sounds in different positions may be present at the same time in multi-channel audio information 247). In this case, FIG. 7 represents the case where the explosion of lighting zone 462*f* is identified as the loudest current sound for display, and it's located between rear center to rear right.

Figure 8:
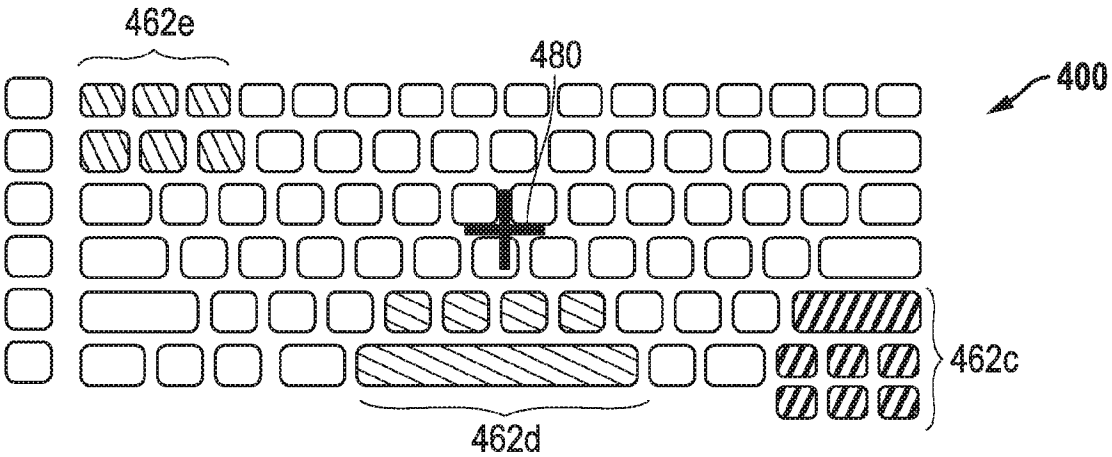
FIG. 8 illustrates a keyboard layout according to one exemplary embodiment of the disclosed systems and methods.

FIG. 8 illustrates similar occurrence of simultaneous sounds as illustrated in FIG. 6. However, in FIG. 8, sound intensity (amplitude) indication has been enabled by checkbox using GUI 283, and thus each of the different lighting zones 462*c*, 462*d* and 462*e* are illuminated with a different intensity that is representative of the loudness of the corresponding sound type (represented by darker cross hatching in FIG. 8), i.e., footsteps of zone 462*c* is the loudest sound (e.g., in decibels) and thus is illuminated with the brightest intensity (or highest luminance), gunshot of zone 462*e* is the second loudest sound and thus illuminated with the second brightest intensity (or second highest luminance), and explosion of zone 462*d* is the third loudest sound (or softest sound) and thus is illuminated with the third brightest intensity (or lowest luminance). Thus, luminous intensity may be employed to distinguish the loudest sounds to softest sounds, e.g., in this exemplary embodiment with three sounds identified by color.

In a further embodiment, light intensity may be adjusted such that full brightness (highest luminous intensity) is associated with the loudest sound and lowest brightness (lowest luminous intensity) is associated with the softest sound. This luminous intensity adjustment may be dynamic in one exemplary embodiment, such that the loudest sound at any given time is associated with full brightness (highest luminous intensity) and the softest sound at any given time is associated with lowest brightness (lowest luminous intensity), regardless of the absolute sound levels of the simultaneously-occurring sounds. This may be done, for example, since the loudest sound occurring at any given time in a computer game is probably of primary concern as its either a very nearby threat or something the user needs to know about and react to quickly.

It will also be understood that one or more of the tasks, functions, or methodologies described herein for an information handing system or component thereof (e.g., including those described herein for 105, 111, 113, 120, 143, 147, 159, 167, 202, 203, 204, 205, 220, 222, 230, 232, 234, 236, etc.) may be implemented using one or more electronic circuits (e.g., central processing units (CPUs), controllers, microcontrollers, microprocessors, hardware accelerators, FPGAs (field programmable gate arrays), ASICs (application specific integrated circuits), and/or other programmable processing circuitry) that are programmed to perform the operations, tasks, functions, or actions described herein for the disclosed embodiments. For example, the one or more electronic circuits can be configured to execute or otherwise be programmed with software, firmware, logic, and/or other program instructions stored in one or more non-transitory tangible computer-readable mediums (e.g., example, data storage devices, flash memories, random access memories, read only memories, programmable memory devices, reprogrammable storage devices, hard drives, floppy disks, DVDs, CD-ROMs, and/or any other tangible data storage mediums) to perform the operations, tasks, functions, or actions described herein for the disclosed embodiments.

For example, one or more of the tasks, functions, or methodologies described herein may be implemented by circuitry and/or by a computer program of instructions (e.g., computer readable code such as firmware code or software code) embodied in a non-transitory tangible computer readable medium (e.g., optical disk, magnetic disk, non-volatile memory device, etc.), in which the computer program comprising instructions are configured when executed (e.g., executed on a processor such as CPU, controller, microcontroller, microprocessor, ASIC, etc. or executed on a programmable logic device "PLD" such as FPGA, complex programmable logic device "CPLD", etc.) to perform one or more steps of the methodologies disclosed herein. In one embodiment, a group of such processors and PLDs may be processing devices selected from the group consisting of CPU, controller, microcontroller, microprocessor, FPGA, CPLD and ASIC. The computer program of instructions may include an ordered listing of executable instructions for implementing logical functions in an information handling system or component thereof. The executable instructions may include a plurality of code segments operable to instruct components of an information handling system to perform the methodology disclosed herein. It will also be understood that one or more steps of the present methodologies may be employed in one or more code segments of the computer program. For example, a code segment executed by the information handling system may include one or more steps of the disclosed methodologies.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touch screen and/or a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A method of displaying display non-graphics positional audio information using an information handling system, comprising:

producing multi-channel audio information from at least one application program executing on at least one processing device of the information handling system, each of the multiple audio channels of the multi-channel audio information representing a different direction of sound origin relative to a virtual point of reference within a graphics scene generated by the application program; and illuminating at least one different non-graphics light source of a group of multiple non-graphics light sources in response to the audio information contained in each of the multiple different audio channels of the multi-channel audio information, each of the multiple non-graphics light sources being positioned on or within an integrated or external computer hardware component in a different direction from a selected point of reference on the integrated or external computer hardware component that is selected to correspond to the virtual point of reference within the graphics scene generated by the application program.

2. The method of claim 1, further comprising:

illuminating one or more non-graphics light sources of a different lighting zone in response to the audio information contained in each of the multiple different audio channels of the multi-channel audio information, the different lighting zones being defined around the selected point of reference on the integrated or external computer hardware component; and producing and graphically displaying the graphics scene generated by the application program on a display area of a display device simultaneous to producing the multi-channel audio information, the virtual point of reference within the displayed graphics scene corresponding to a virtual position of a user within the displayed graphics scene.

3. The method of claim 1, further comprising:

receiving lighting profile configuration information from a user, the user-defined lighting profile information defining at least one of an assignment of each different non-graphics lighting source to a given one of the multiple different audio channels of the multi-channel audio information, an assignment of a different non-graphics lighting source brightness levels to different audio channel sound volume levels in the multi-channel audio information, or an assignment of different non-graphics lighting source colors to different audio channel types in the multi-channel audio information; and then illuminating at least one different non-graphics light source of a group of multiple non-graphics light sources in response to the audio information contained in each of the multiple different audio channels of the multi-channel audio information according to the user-defined lighting profile information.

4. The method of claim 1, wherein the integrated or external computer hardware component is a display device having a bezel that surrounds a graphics display area; where the multiple different non-graphics light sources are positioned on the bezel at multiple different locations around a periphery of the graphics display area.

5. The method of claim 1, wherein the integrated or external computer hardware component is a keyboard device; where the multiple different light sources are positioned to light different individual keys at multiple different locations around a selected point of reference of the keyboard.

6. The method of claim 1, further comprising:

producing the multi-channel audio information with at least a first one of the multiple audio channels of the produced multi-channel audio information varying in sound volume level over time; and illuminating at least one different non-graphics light source corresponding to the first one of the multiple audio channels with different brightness levels that are based on the real time sound volume level of the first one of the multiple audio channels.

7. The method of claim 1, further comprising:

producing the multi-channel audio information with at least a first one of the multiple audio channels of the produced multi-channel audio information containing different types of sounds over time; and illuminating at least one different non-graphics light source corresponding to the first one of the multiple audio channels with different colors that are based on the real time sound type contained in the first one of the multiple audio channels.

8. The method of claim 1, further comprising:

producing the multi-channel audio information with each of the multiple audio channels of the produced multi-channel audio information varying in sound volume level over time; and illuminating only the at least one different non-graphics light source corresponding to a given one of the multiple audio channels that currently has the highest real time sound volume level at any given time, and not illuminating any of the other non-graphics light sources that do not correspond to the given one of the multiple audio channels that currently has the highest real time sound volume level any given time.

9. The method of claim 1, further comprising:

producing multi-channel audio information from multiple application programs executing at the same time on at least one processing device of the information handling system, each of the multiple audio channels of the multi-channel audio information representing a different direction of sound origin relative to a virtual point of reference within a graphics scene generated by a corresponding one of the application programs;

selecting multi-channel audio information generated from only a portion of the simultaneously executing multiple application programs; and illuminating at least one different non-graphics light source in response to the audio information contained in each of the multiple different audio channels of the selected multi-channel audio information.

10. The method of claim 1, further comprising:

producing multi-channel audio information from multiple types of application programs executing at the same time on at least one processing device of the information handling system, each of the multiple audio channels of the multi-channel audio information representing a different direction of sound origin relative to a virtual point of reference within a graphics scene generated by a corresponding one of the application programs;

selecting a multi-channel audio information content type that is generated from only a portion of the simultaneously executing multiple application programs; and illuminating at least one different non-graphics light source in response to the audio information contained in each of the multiple different audio channels of only the selected multi-channel audio information content type.

11. The method of claim 1, further comprising:

producing combined multi-channel audio information from multiple application programs executing at the same time on at least one processing device of the information handling system, each of the multiple audio channels of the multi-channel audio information representing a different direction of sound origin relative to a virtual point of reference within a graphics scene generated by a corresponding one of the application programs; and illuminating at least one different non-graphics light source in response to the audio information contained in each of the multiple different audio channels of the combined multi-channel audio information.

12. An information handling system, comprising:

at least one integrated or external computer hardware component;

multiple non-graphics light sources being positioned on or within the integrated or external computer hardware component;

at least one processing device coupled to control illumination of the multiple light sources, the at least one processing device being programmed to:

execute at least one application program to simultaneously generate a graphics scene and multi-channel audio information associated with the graphics scene, each of the multiple audio channels of the multi-channel audio information representing a different direction of sound origin relative to a virtual point of reference within the graphics scene generated by the application program; and control illumination of at least one different non-graphics light source of a group of multiple non-graphics light sources in response to the audio information contained in each of the multiple different audio channels of the multi-channel audio information, each of the multiple non-graphics light sources being positioned on or within an integrated or external computer hardware component in a different direction from a selected point of reference on the integrated or external computer hardware component that is selected to correspond to the virtual point of reference within the graphics scene generated by the application program.

13. The system of claim 12, where the processing device is programmed to control illumination of one or more non-graphics light sources of a different lighting zone in response to the audio information contained in each of the multiple different audio channels of the multi-channel audio information, the different lighting zones being defined around the selected point of reference on the integrated or external computer hardware component.

14. The system of claim 12, where the integrated or external computer hardware component is a display device having a bezel that surrounds a graphics display area; where the different non-graphics light sources are positioned on the bezel at multiple different locations around a periphery of the graphics display area; and where the processing device is programmed to produce and graphically display the graphics scene generated by the application program on a display area of the display device simultaneous with production of the multi-channel audio information, the virtual point of reference within the displayed graphics scene corresponding to a virtual position of a user within the displayed graphics scene.

15. The system of claim 12, where the integrated or external computer hardware component is a keyboard device; where the different light sources are positioned to light different individual keys at multiple different locations around a selected point of reference of the keyboard; and where the processing device is programmed to produce and graphically display the graphics scene generated by the application program on a display area of a display device coupled to the processing device simultaneous with production of the multi-channel audio information, the virtual point of reference within the displayed graphics scene corresponding to a virtual position of a user within the displayed graphics scene.

16. The system of claim 12, where the processing device is programmed to:

produce the multi-channel audio information with at least a first one of the multiple audio channels of the produced multi-channel audio information varying in sound volume level over time; and control illumination of at least one different non-graphics light source corresponding to the first one of the multiple audio channels with different brightness levels that are based on the real time sound volume level of the first one of the multiple audio channels.

17. The system of claim 12, where the processing device is programmed to:

produce the multi-channel audio information with at least a first one of the multiple audio channels of the produced multi-channel audio information containing different types of sounds over time; and control illumination of at least one different non-graphics light source corresponding to the first one of the multiple audio channels with different colors that are based on the real time sound type contained in the first one of the multiple audio channels.

18. The system of claim 12, where the processing device is programmed to:

produce the multi-channel audio information with each of the multiple audio channels of the produced multi-channel audio information varying in sound volume level over time; and control illumination of only the at least one different non-graphics light source corresponding to a given one of the multiple audio channels that currently has the highest real time sound volume level at any given time, and not illuminating any of the other non-graphics light sources that do not correspond to the given one of the multiple audio channels that currently has the highest real time sound volume level any given time.

19. An information handling system, comprising:

at least one processing device configured to be coupled to at least one integrated or external computer hardware component, the at least one integrated or external hardware component having multiple non-graphics light sources being positioned on or within the integrated or external computer hardware component;

where the at least one processing device is programmed to control illumination of the multiple light sources when the processing device is coupled to the integrated or external computer hardware component, the at least one processing device being programmed to:

execute at least one application program to simultaneously generate a graphics scene and multi-channel audio information associated with the graphics scene, each of the multiple audio channels of the multi-channel audio information representing a different direction of sound origin relative to a virtual point of reference within the graphics scene generated by the application program; and generate lighting event commands to cause illumination of at least one different non-graphics light source of a group of multiple non-graphics light sources in response to the audio information contained in each of the multiple different audio channels of the multi-channel audio information, each of the multiple non-graphics light sources being positioned on or within an integrated or external computer hardware component in a different direction from a selected point of reference on the integrated or external computer hardware component that is selected to correspond to the virtual point of reference within the graphics scene generated by the application program.

20. The system of claim 19, where the at least one processing device is programmed to:

generate one or more light event commands to cause illumination of one or more non-graphics light sources of a different lighting zone in response to the audio information contained in each of the multiple different audio channels of the multi-channel audio information, the different lighting zones being defined around the selected point of reference on the integrated or external computer hardware component; and produce the graphics scene generated by the application program for display on a display area of a display device simultaneous to producing the multi-channel audio information, the virtual point of reference within the displayed graphics scene corresponding to a virtual position of a user within the displayed graphics scene.

* * * * *